US008579226B2

(12) United States Patent
Deale et al.

(10) Patent No.: US 8,579,226 B2
(45) Date of Patent: Nov. 12, 2013

(54) POWER ASSISTED TOY FLYING DEVICE

(75) Inventors: Valentine Deale, Kensington, MD (US); Peter Loehnert, Solingen (DE)

(73) Assignee: Premier Kites, Inc., Hyattsville, MD (US)

( * ) Notice: Subject to any disclaimer, the term of this patent is extended or adjusted under 35 U.S.C. 154(b) by 468 days.

(21) Appl. No.: 12/761,457

(22) Filed: Apr. 16, 2010

(65) Prior Publication Data

US 2011/0089288 A1 Apr. 21, 2011

Related U.S. Application Data

(63) Continuation-in-part of application No. 12/588,623, filed on Oct. 21, 2009.

(51) Int. Cl.
*B64C 15/12* (2006.01)

(52) U.S. Cl.
USPC ..... 244/12.4; 244/51; 244/56; 244/66

(58) Field of Classification Search
USPC ..... 244/12.4, 13, 51, 56, 66, 153 R, 190, 244/155 A; 446/57
See application file for complete search history.

(56) References Cited

U.S. PATENT DOCUMENTS

| | | | | |
|---|---|---|---|---|
| 857,949 | A | 6/1907 | Malloy | |
| 1,186,630 | A | 6/1916 | Warchalowski | |
| 1,229,114 | A | 6/1917 | Meng et al. | |
| 1,326,760 | A * | 12/1919 | Macinante | 440/57 |
| 1,879,345 | A | 9/1932 | Lawrence | |
| 2,131,155 | A * | 9/1938 | Waller | 244/51 |
| 2,318,862 | A | 5/1943 | Iredell et al. | |
| 2,478,847 | A * | 8/1949 | Stuart | 244/7 R |
| 3,361,388 | A | 1/1968 | Girard et al. | |
| 3,940,882 | A | 3/1976 | Mabuchi | |
| 4,180,221 | A | 12/1979 | Harris | |
| 4,204,656 | A | 5/1980 | Seward, III | |
| 5,034,759 | A | 7/1991 | Watson | |
| 5,383,627 | A * | 1/1995 | Bundo | 244/26 |
| 5,906,335 | A * | 5/1999 | Thompson | 244/96 |
| 6,257,525 | B1 | 7/2001 | Matlin et al. | |
| 6,364,251 | B1 | 4/2002 | Yim | |
| 6,386,480 | B1 * | 5/2002 | Perry et al. | 244/24 |

(Continued)

OTHER PUBLICATIONS

Office Action and Form 892, mailed Feb. 17, 2012 from corresponding U.S. Appl. No. 12/588,623.

(Continued)

*Primary Examiner* — Philip J Bonzell
(74) *Attorney, Agent, or Firm* — Thomas & Karceski, PC

(57) ABSTRACT

A power assisted flying device is powered via a vector thrust control apparatus supporting the motor where the vector thrust control apparatus includes a gyratory group that allows the motor to pivot up and down and from side to side. At least two servo motors are attached to the vector thrust control apparatus to move said motor up and down and from side to side. Alternatively, the flying device may incorporate a non-rotating outer ring and a rotating inner ring disposed around a shaft. At least two servo motors are connected to the non-rotating outer ring and the rotating inner ring in relation to the rotational axis. At least two linkage rods connect between the rotating inner ring and the propeller. Tilting of the non-rotating outer ring is transmitted to the propeller to effectuate at least one of cyclic pitch modulation or teetering hub modulation of the propeller.

16 Claims, 19 Drawing Sheets

(56) References Cited

U.S. PATENT DOCUMENTS

| | | | | |
|---|---|---|---|---|
| 6,471,159 | B1 * | 10/2002 | Bundo | 244/26 |
| 6,708,920 | B2 * | 3/2004 | Fukuyama | 244/12.4 |
| 6,793,172 | B2 | 9/2004 | Liotta | |
| 6,892,980 | B2 * | 5/2005 | Kawai | 244/12.4 |
| 6,976,899 | B1 * | 12/2005 | Tamanas | 446/178 |
| 7,048,232 | B1 | 5/2006 | Plottner | |
| 7,109,598 | B2 | 9/2006 | Roberts et al. | |
| 7,183,663 | B2 | 2/2007 | Roberts et al. | |
| 7,377,832 | B2 | 5/2008 | Chamberlain | |
| 7,874,515 | B2 * | 1/2011 | Kinkopf et al. | 244/56 |
| 8,245,966 | B2 * | 8/2012 | Colting | 244/56 |
| 2008/0179452 | A1 | 7/2008 | Kinkopf et al. | |
| 2010/0224722 | A1 * | 9/2010 | Colting | 244/51 |

OTHER PUBLICATIONS

Examination Report dated Jan. 3, 2013, in corresponding German Patent Application No. 10 2010 037 916.6-15.

* cited by examiner

103

105

106

POWER ASSISTED TOY FLYING DEVICE

CROSS-REFERENCE TO RELATED APPLICATION(S)

This is a Continuation-In-Part Non-Provisional Patent Application that relies for priority on U.S. patent application Ser. No. 12/588,623, filed on Oct. 21, 2009, the contents of which are incorporated herein by reference.

FIELD OF THE INVENTION

The invention relates to a power assisted toy flying device. More specifically, the invention concerns a radio-controlled kite or similar toy.

BACKGROUND OF THE DISCLOSURE

Kites have been in existence for hundreds of years. They are generally made with wood, solid or tubular fiberglass, carbon rods, light weight plastic, and/or fabric. The kite is a tethered aerodyne and is in a stalled state against the wind. The disadvantage of a kite is that it needs line and wind to fly. Over the years, there have been a number of efforts directed towards the improvement of a power assisted flying device. These efforts have focused on improving the directional controls of radio controlled kite-like objects and airplane models.

In the mid 1990's Dan Kreigh of California developed a radio controlled kite-like flying object. The shape was formed by one fiberglass rod in a simple pattern of a semi-circle. Dan Kreigh's version of the radio controlled kite used rudder and elevators for control. In the late 1990's, Michael Lin of Singapore expanded on Dan Kreigh's approach by making the shapes more elaborate. However, Michael Lin's versions also depended on the use of rudder and elevators for control. All were controlled by moving control surfaces.

Moving control surfaces have been used on aircraft since the dawn of flight; however, they include many disadvantages for controlling kites. By nature, kites are often larger and slower moving than traditional remote controlled aircraft. While flying objects have great advantages for ease of remote controlled flight, slow moving flying objects need to have large lightweight wing areas and proportionally large moving surfaces to control flight. This is because when there is slow or no air rushing across a control surface, the control surface fails to move the object in the intended direction. Since kites by nature are slow moving, to steer them by moving control surfaces require very large moving surfaces, which in turn are difficult for most standard servos to move. Further, by nature, kites are much lighter per size than traditional aircraft and are able to sometimes "stop" and "float" on the wind. Moving control surfaces are completely ineffective at controlling an object that simply "stops" in the air.

In addition, moving control surfaces require hinges attached to ridged structures such as a fuselage or an airframe. Kites rarely have ridged members strong enough to attach the necessary hinges and control surfaces in the correct areas for effective control of the kite. Since moving control surfaces for kite-like flying objects have to be large, this condition results in more performance robbing weight and less room on the kite for lifting surfaces which are so important for an effective flying kite.

In 2006, Peter Loehnert of Solingen, Germany started to develop kite-like flying objects using a new vector thrust concept. Directional control was achieved by the use of a brushless electric motor, propeller and two servos. One servo provided the up-down motion control while the other servo provided the left-right motion control. The brushless electric motor and propeller were directly connected to the moving axle of the left-right servo and thus when the axle of the servo turned clockwise or counterclockwise, the motor and spinning propeller also shifted left and/or right thereby directing thrust and steering the kite left or right. The left-right servo, with the connected motor assembly, was then connected to the moving axle of the up-down servo. Thus, when the axle of the up-down servo turned clockwise or counterclockwise, the left-right servo, motor and spinning propeller moved up and down thus directing thrust to control the pitch of the kite. Pitch, yaw, roll and forward speed were achieved by the combination of up-down and left-right thrust positioning along with proportional speed control of the motor. Since the thrust on the propulsion unit can be totally directed by both magnitude and direction, the propulsion assembly is typically called a vector thrust control unit. In this system, no moving control surfaces are used or needed.

Although the Loehnert system worked well, there are several disadvantages to this system for motorizing and controlling kites. First, commercially available servos to this date are not designed to accommodate the stresses developed by direct linkage to the motor and other servos. Thus many servos were over-stressed and failed frequently, rendering the power unit useless. In addition, of the few servos available that could marginally withstand the stress, these servos were very high in price and difficult for many consumers to afford. Furthermore, all of the components—motor and servos—were glued together in one integral unit, making replacement of individual parts impossible.

U.S. Pat. No. 4,204,656 (Seward) discloses a freeflying miniblimp comprising a frame, a balloon containing lighter-than-air gas and a control system for said miniblimp, said control system consisting of a single drive motor, a propeller attached to said drive motor and rotated by said drive motor, a bracket to which is mounted said drive motor, an ascent/descent motor, first means for attaching said ascent/descent motor to said bracket to tilt said drive motor upward or downward, a left/right motor, second means for attaching said left/right motor to turn said drive motor left or right, a single fixed vertical stabilizer secured to said miniblimp and having an absence of moving parts, an energy source and control means for said motors functionally connected to said motors.

U.S. Pat. No. 7,109,598 (Roberts et al.) discloses one or more tethered platforms, each having three or more mill rotors, that are operated at altitudes in relatively high winds to generate electricity. These windmill kites use one or more electro-mechanical tethers on each platform. Their position, attitude and orientation are monitored by one or more GPS receivers and/or gyros and controlled through differential thrusts and torque-reactions produced by the mill rotors. The kites can be electrically powered from a ground supply during relatively calm periods, or landed if desired. During windy periods the kites may be used to generate electricity by tilting the rotors at an angle, or incidence to the on-coming wind. In this generate mode the mill rotors simultaneously develop thrust while generating electricity. See also U.S. Pat. No. 7,183,663.

U.S. Pat. No. 7,048,232 (Plottner) discloses a kite that is flown by means of two control lines and which has two counter rotating 50 inch rotors and which can be flown in winds of 9 miles per hour and greater. This rotor kite can take off, fly in the air at various heights and then be landed by the operator on its rear legs with no harm to the spinning rotors. Manipulation of the rotor kite in the air is possible at all times as the two major merits of this disclosure are its fly ability and its control ability.

U.S. Pat. No. 6,793,172 (Liotta) discloses an aircraft which is designed for remote controlled slow flight, indoor or in a small outdoor yard or field. The aerial lifting body is defined by a series of lightweight planar or thin airfoil surfaces (A1, A2, A3, A4) arranged in a radially symmetrical configuration. Suspended within the cavity (O) formed by the thin airfoil surfaces (A1, A2, A3, A4) is a thrust generating propeller system (C) that is angled upwardly and that can be regulated remotely so as to change the angle of the thrust vector within the cavity (O) for steering. Lifting, stability, turning, and general control of the direction of motion in flight is accomplished without any formal wings, rudder, tail, or control surfaces.

U.S. Pat. No. 6,257,525 (Matlin et al.) discloses a remotely controlled aircraft having a center member and a steering assembly. The steering assembly comprises a carriage, a remote control motor, a center member and a connecting arm. The carriage pivotably is attached to the center member. The remote control motor has a control arm and is disposed within the carriage. The center member arm has a first end and a second end. The first end of the center member arm is fixedly attached to the center member. The center member and the center member arm is arranged in a non-parallel manner. The connecting arm has a first end and a second end. The first end of the connecting arm is pivotably attached to the second end of the center member arm. The second end of the connecting arm is pivotably attached to the control arm of the remote control motor.

U.S. Pat. No. 5,034,759 (Watson) discloses an aerial still camera including: a video camera; a device for elevating the video camera relative ground level; structure for suspending the video camera from the elevating device; first self-leveling structure for leveling the video camera in a first direction; second self-leveling structure for leveling the video camera in a second direction; first drive structure for rotating the video camera to control the image scanned by the video camera along a first axis; second drive structure for rotating the video camera to control the image scanned by the video camera along a second axis; a tether attached at one end to the elevating device for holding the elevating device and the video camera in the elevated position, the tether including electrical conductors; and an electrical control device attached at another end of the tether for controlling the first and second drive structure so as to control the image scanned by the video camera, the control structure further including a video display so to display the image scanned by the video camera.

SUMMARY OF THE DISCLOSURE

This disclosure relates to a method of propulsion and control of kites and kite-like objects by means of a remote controlled vector thrust control apparatus mounted to the frame of a kite or kite-like object. No wind or line is necessary to fly this kite-like flying object.

In one embodiment of the disclosure a kite or kite-like flying object is powered by one or more brushless electric motors, propellers, remote controllers, batteries, and is controlled by the use of at least one motor with one or more servos using a gimbal device.

In another embodiment, an assembly for a vector thrust control apparatus is taught for kite or kite-like flying objects in which components are directly connected to each other. In particular, the disclosure relates to an improved connection system for motor and servo components to permit the ease of assembly, including ease of disassembly and convenient structures for anchoring the vector power and control system to the frame of a kite or kite-like flying object.

In another embodiment, a multiple part frame fitting is taught to allow kite or kite frame parts and vector thrust control apparatus parts to be easily detached and re-attached from one another and include provisions for shock absorption at the frame attachment points.

In yet another embodiment, an assembly for a vector thrust control apparatus for kites and kite-like flying objects is disclosed in which the propulsion and vector control components that are combined as an integrated group can be easily detached and re-attached to the propulsion frame and/or frame of the kite.

In yet another embodiment, an assembly for a vector thrust control apparatus for kites is disclosed in which the propulsion and vector control components can be installed and flown in a rotating kite.

In another embodiment, the vector thrust control apparatus supporting the motor includes a gyratory group that allows the motor to pivot up and down and from side to side.

In still another embodiment, the vector thrust control apparatus includes a gimbal mechanism with two brackets and four pivot points.

One further embodiment contemplates a vector thrust control apparatus including a gimbal mechanism with at least one bracket and two pivot points.

Still another embodiment contemplates a vector thrust control apparatus including a gimbal mechanism with at least one bracket and three pivot points.

The vector thrust apparatus may also include a gimbal mechanism with a central spherical pivot, an outer ring around the central spherical pivot, and at least two attachment points for attachment to the servo motors.

It is contemplated, in one embodiment of the invention, that the vector thrust apparatus may include a multi-pivoting bracket behind the propeller and the bracket. The multi-pivoting bracket may tilt up and down and from right to left.

It is also contemplated that the vector thrust apparatus may include an elongated flexible connector to permit directional thrust in up and down and right to left directions.

The kite-like object may include, in one contemplated embodiment, a control surface on a wing.

In another contemplated embodiment, the kite-like object may include a propeller on a shaft, a non-rotating outer ring disposed around the shaft, a rotating inner ring operatively connected to the non-rotating outer ring, and linkage rods connecting the rotating inner ring with the propeller to effectuate either cyclic pitch modulation or teetering hub modulation of the propeller.

Where cyclic pitch modulation is employed, the pitch of at least one of the blades is altered during one complete revolution of the propeller.

Where teetering hub modulation is employed, the propeller is tilted in relation to the rotational axis.

The present invention contemplates that the thrust for the kite-like object may be provided in a tractor mode of operation.

The present invention also contemplated that the thrust for the kite-like object may be provided in a pusher mode of operation.

BRIEF DESCRIPTION OF THE FIGURES

The figures of the present disclosure appended hereto are not intended to limit the scope of the disclosure in any way. In the figures.

Other embodiments of the present invention will be evident from the following detailed description, with like reference numbers referring to like items throughout.

DETAILED DESCRIPTION OF THE DISCLOSURE

Figure 1A:
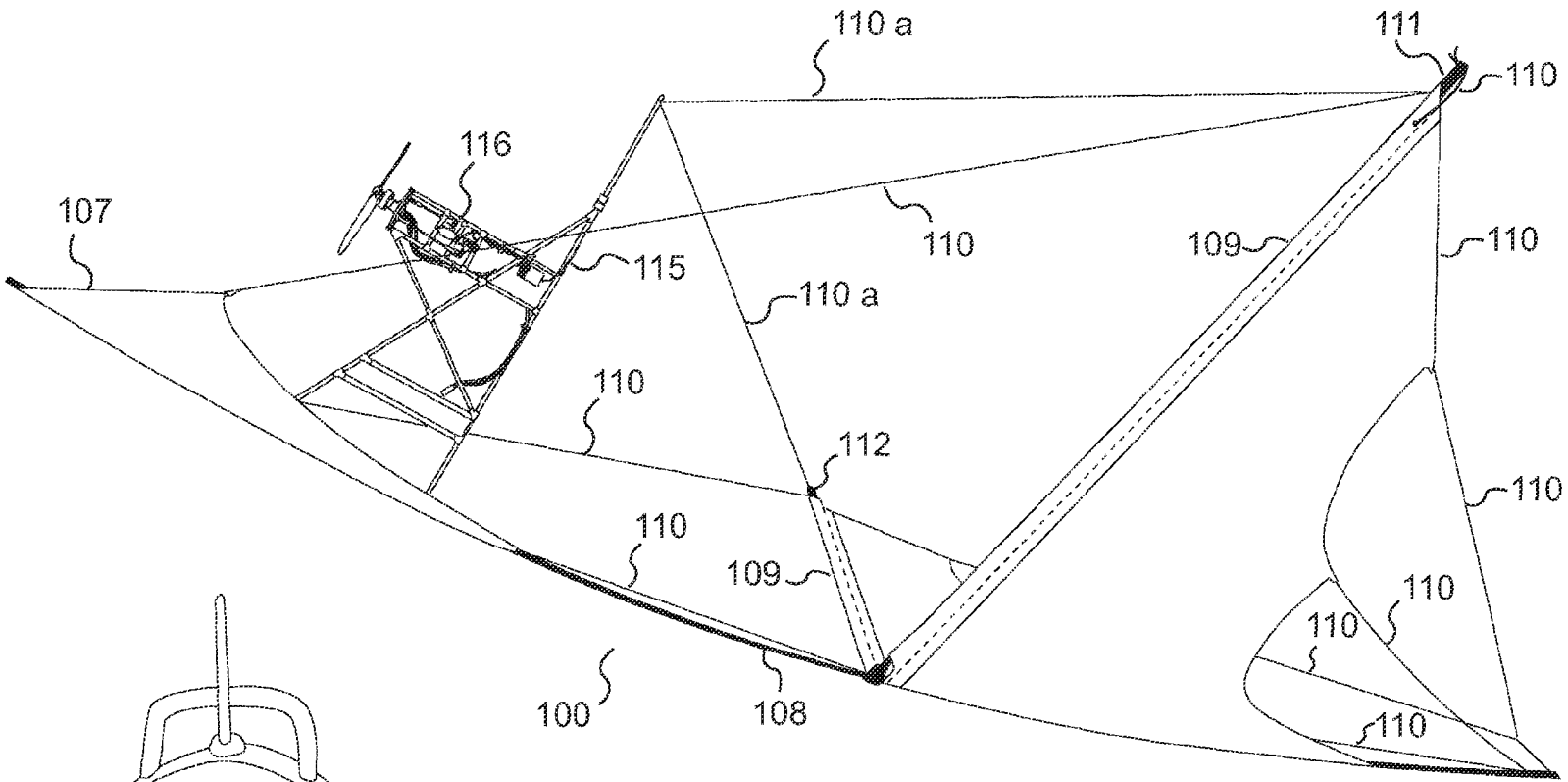
FIGS. 1A-1B are perspective views of one embodiment of the present disclosure.

FIG. 1A illustrates motorized kite 100 of the present disclosure. The kite 100 shown is two surface canard kite. As shown in FIGS. 2A through 2F, the kite-like object 101, 102, 103, 104, 105, 106 may take on any suitable kite or kite-like shape. Kite-like object 101 includes a vector thrust control apparatus and is made up of two triangular pieces of fabric. Without the vector thrust control apparatus the object is technically known as a Marconi Jib kite and can fly with traditional kite line and wind. Without the vector thrust control apparatus, 101 can also be made into an uncontrolled glider with some adjustments to the center of gravity. Kite-like object 102 also includes a vector thrust control apparatus and takes on a more traditional aircraft shape. Kite-like object 102 comprises a standard wing, elongated fuselage, stabilizer and fixed rudder. Without the vector thrust control apparatus, the kite-like object 102 can also function as a traditional kite or, with proper adjustment of the center of gravity, an uncontrolled glider. Although kite-like object 102 does not immediately suggest the shape of a traditional kite, it is still able to be flown as a kite with line and wind. Kite-like object 103 has roots in traditional cellular kite shapes. Without the vector thrust control apparatus, they could also be flown as traditional kites with line and wind. Kite-like object 104 shows a flying object made out of foamed plastic material. The flying object represents the shape of a biplane aircraft. Similar to kite-like objects 101, 102, 103, 105 and 106, kite-like object 104 can be powered and flown with the disclosed vector thrust control apparatus. In a similar fashion as kite-like object 101, the kite-like objects 102, 103, 104, 105 and 106 can be made to fly as uncontrolled gliders with an adjustment in the center of gravity. When powered by a vector thrust control apparatus, kites as seen in 101, 102, 103, 104, 105 and 106 can also be flown under power and control.

It is important to understand that the vector thrust control apparatus may be applied to many different shapes and configurations including kite shapes, kite-like shapes, aircraft and aircraft-like shapes and configurations. The kite-like object may take on any suitable shape (any type of aircraft-like or other suitable decorative design). It is also important to understand that, when equipped with the said vector thrust control apparatus, many different shapes and configurations including kite shapes, kite-like shapes, aircraft and aircraft-like shapes, animal shapes, human shapes, inanimate object shapes or any geometric shape can be powered and controlled in the air without the use of moving control surfaces. In other words, the overall shape and appearance of the kite-like flying object encompasses decorative and non-functional aspects that are not relevant to the utilitarian features of the present disclosure.

Figure 2:
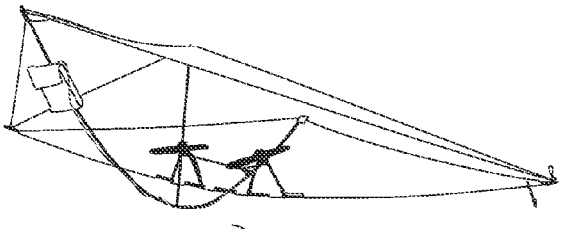
FIGS. 2A-2F are perspective views of several possible kite embodiments.
Figure 2:
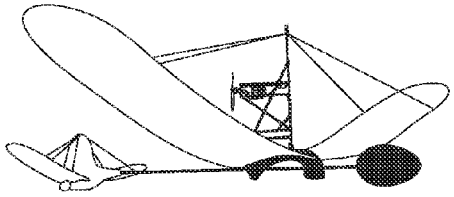
Figure 2C:
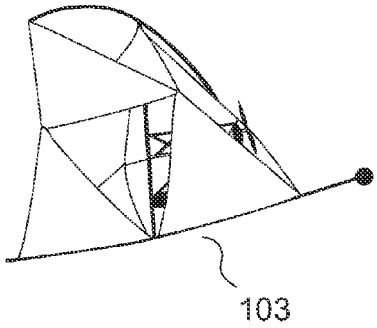
Figure 2:
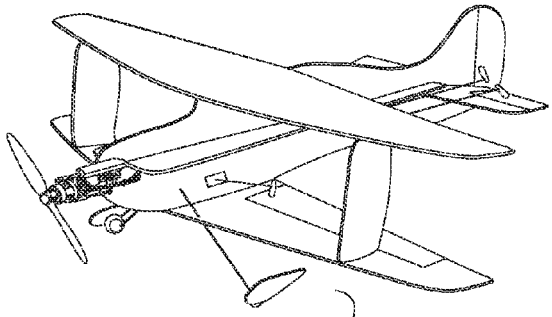
Figure 2E:
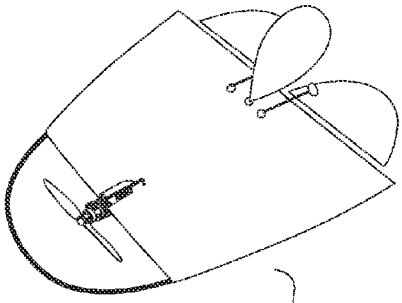

Kite-like objects 101, 102, 103, 104, 105, and 106 can be controlled and flown by the said vector thrust control apparatus alone or with the vector thrust control apparatus in combination with moving control surfaces. In FIGS. 2D and 2E, the kite-like objects 104 and 105 include moving control surfaces as seen in traditional aircraft that include ailerons, and a hinged rudder. These moving control surfaces are actuated by servo motors that take commands from the same remote wireless mechanism as the vector thrust control apparatus. The kite-like objects 104 and 105 also include a vector thrust control unit. The advantages of having both vector thrust control and moving control surface methods on the same flying object include: increased control, especially in completely stalled states, aerobatic maneuvers that are difficult or impossible to achieve with moving control surface methods alone and increased control due to declining motor performance due to a malfunction or decrease in battery power. Controlling flying objects by vector thrust alone is predicated on controlling the direction of thrust. In a situation of decreased or complete loss of thrust, a combination described above that includes moving control surfaces and a vector thrust control apparatus may enable a remotely controlled flying object to safely return to the operator. The vector thrust control apparatus can be used alone in a kite-like object with no moving control surfaces or used in conjunction with moving control surfaces to add enhanced control of a kite-like object.

Figure 2F:
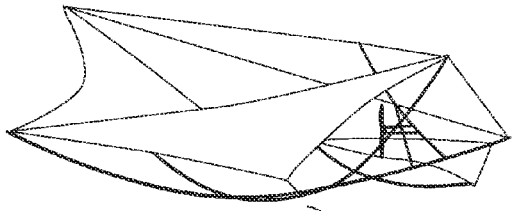

Kite 100 contains a flexible material covering or skin 107 comprised of plastic, cloth and/or other lightweight material such as expanded plastic foam. The lightweight skin is attached to a kite frame 108 typically, but not always, by constructing sleeves 109 in the fabric skin for the framing material to be secured. Other methods of skin to frame attachment can include adhesive tape, adhesive glue and or heat sealing. In yet another example of frame to skin connection, tensioning lines 110 that go from frame to skin are held in suspension by the frame tension securing the frame to the skin. It is contemplated that one may use a kite without sleeves whose skin is attached to the frame by tensioning lines alone, as shown in FIG. 2F, for the kite-like object 106.

In the embodiment illustrated, the kite frame 108 consists of a longitudinal strut and two opposing cross struts 111 and 112. The kite frame 108 could consist of as few as one strut, but not limited to, a plurality of struts in any orientation. In the embodiment illustrated, the kite frame 108 is constructed out of lightweight carbon rod. While lightweight carbon rod may be used, it is also contemplated that the frame could be made out of natural material such as bamboo or wood or other man-made materials such as fiberglass, metal, aluminum, or plastic or any other suitable material (or combination of materials) that may be incorporated onto at least one portion of the kite frame 108. Further, it is also contemplated that the kite frame 108 could rely on air inflation as in the case of a pumped-up sealed bladder or ram-air inflation similar to a double surfaced parafoil kite.

Further it is contemplated that the kite frame 108 and flexible skin 107 could be made out of foam material such as expanded polystyrene in which case the frame and flexible skin material would be integrated as one entity. This integration could be used to simplify mass production of the kite-like objects.

Figure 3:
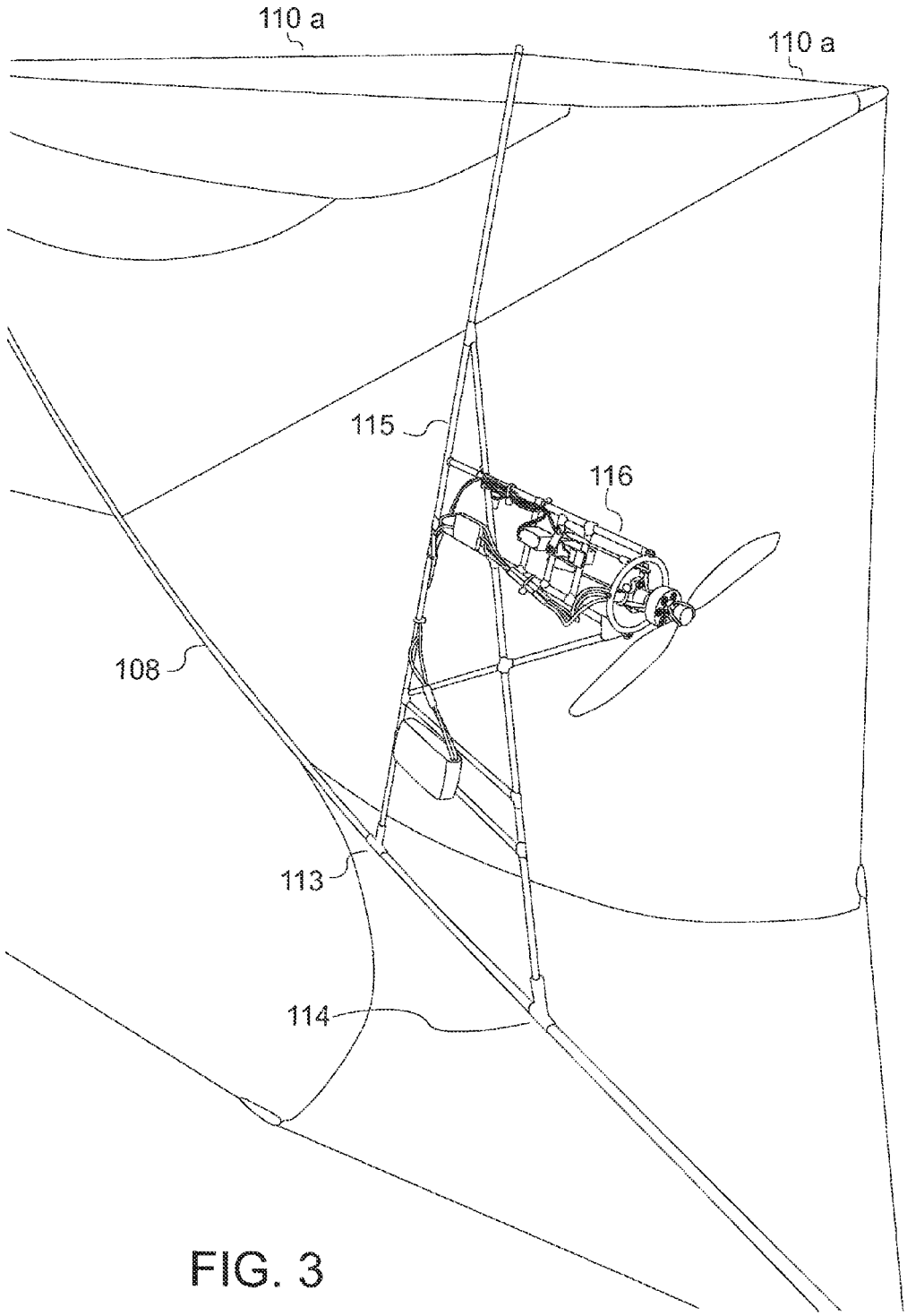
FIG. 3 is a perspective view of the attachment of the propulsion frame and vector thrust control apparatus to the frame of a kite.

In the embodiment illustrated in FIG. 3, the kite frame 108 incorporates two propulsion frame fittings 113 and 114 made out of a flexible rubber-like material and includes apertures to receive the propulsion frame 115 and vector thrust control unit 116. Different kite shapes could require at least one propulsion frame fitting, but not limited to, a plurality of fittings to secure the propulsion frame into the frame of the kite. The propulsion frame fittings could be made out of plastic, metal, aluminum, or other materials. In the illustrated embodiment, the apertures of the fittings are slightly smaller than the outside diameters of the propulsion frame rods. The rubber-like flexible material of the fittings allow the fittings to grip the propulsion frame rods securely and allow the operator, with a slight amount of force, to also detach the propulsion frame from the kite for purposes of disassembly. Alternately, the propulsion frame fittings may include threaded tightening rings, pinning rods, nuts and bolts and or other suitable means to tighten the propulsion frame struts to the kite frame.

Figure 4A:
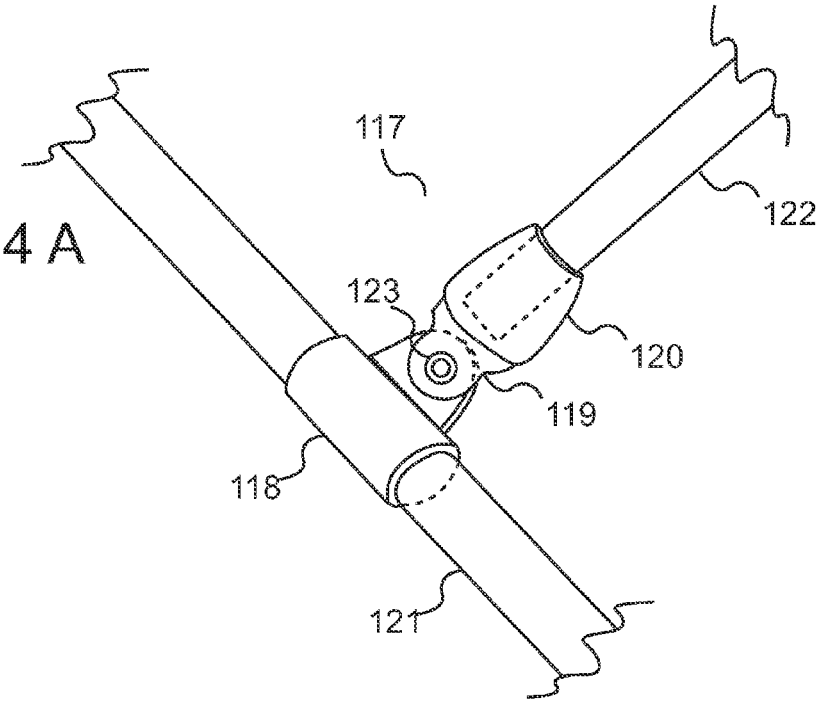
FIGS. 4A-4C illustrate novel frame connections fitting to easily connect and disconnect frame material for kites and kite-like objects.
Figure 4B:
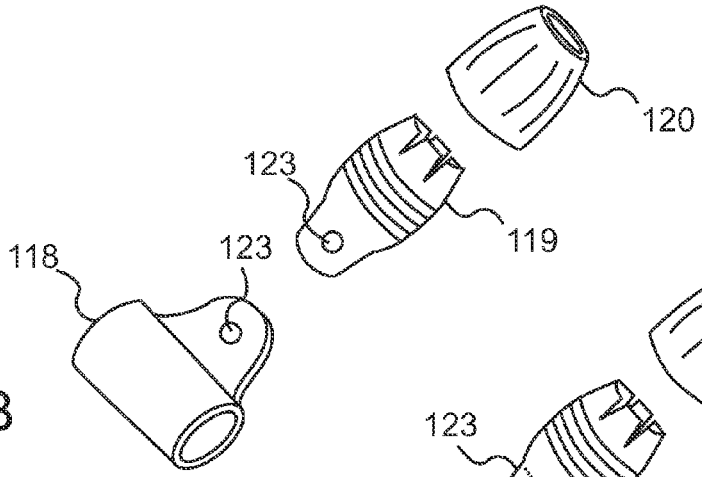
Figure 4C:
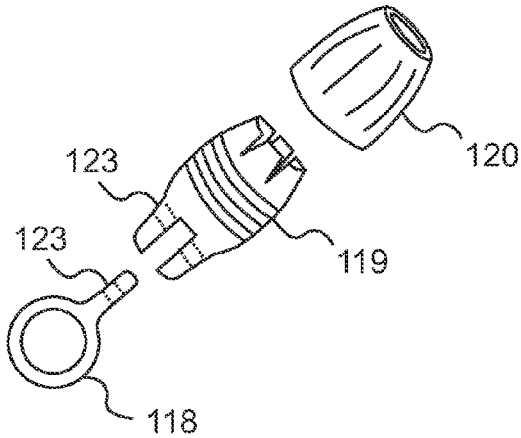

FIG. 4A shows another embodiment of a frame fitting 117 that includes three parts. The open channel component 118 can be installed in any suitable frame strut 121 and can be made in a round, square, or multisided cross section or any cross section suitable to the framing material. In the present embodiment the open channel component's cross section is round. Although the open channel component 118 is open on both ends as illustrated in FIGS. 4A-4C, the open channel component 118 could have a closed end. The second part of the frame fitting 117, known as the receiver module 119, is threaded and is made to fit a constrictor collar 120. When a framing strut is inserted into the receiver module 119 the constrictor collar 120 is then tightened and because the constrictor collar 120 is constructed on an incline plane, the receiver module 119 includes an inside aperture with a reduced diameter and, thus, produces a tight grip on the framing rod 122. The open channel component 118 is made out of a rubber like material. Many other materials could be used for the open channel component such as any man-made or natural elastomers. The open channel 118 may be made out of a rigid material such as plastic or metal instead of a flexible material such as rubber or a rubber-like substance. The receiver module 119 is made out of molded plastic but could be made out of reinforced plastic, fiberglass, metal, aluminum, steel and/or other types of suitable materials. The constrictor collar 120 is made out of molded plastic but could be made out of reinforced plastic, fiberglass, metal, aluminum, steel and/or other types of suitable materials.

Making the kite and kite-like object frame fittings out of different components and different materials have numerous advantages. Since the open channel component 118 is made out of a flexible material such as rubber or a man-made elastomer, the fitting can absorb shock and trauma such as in an inadvertent crash of a kite or kite-like object. On the other hand, a stiffer material such as plastic used for the receiver module 119 and the constrictor collar 120 provide for a firm grip on the attaching framing material 122.

The ability to easily construct different framing angles on kites and kite-like objects is another embodiment of the disclosure. Aperture 123 is provided for nuts and bolts, pins and/or but not limited to pop rivets that join the open channel component 118 and the receiver module 119 together. The two parts 118 and 119 can be rotated to different angles before assembly thus allowing a great freedom of framing attachment angles. The orientation of the two part system can be either fixed by a firm connection at aperture 123 such as with a pop-rivet or the orientation can be user adjustable, as such the case with a nut and bolt.

In the embodiment illustrated in FIG. 1A, the propulsion frame 115, vector thrust control unit 116 and propulsion frame fittings FIG. 3, 113 and 114 (FIG. 3), are stabilized to the kite frame by tension line 110*a*. Although in this embodiment there is one upper tension line, a plurality of tensioning lines to secure the propulsion frame to the kite frame could be used, depending on the intended kite shape. Alternatively, the propulsion frame 115 and vector thrust control unit 116 may be connected to the kite with no tensioning lines at all, but may be secured by only the connecting points of the propulsion frame struts and the kite framing. In a second embodiment shown in FIG. 7, a propulsion frame 135 is illustrated with no tensioning lines but relies on rigid connection points to the frame. Alternately, it is contemplated that the propulsion frame 115 and vector thrust control unit 116 can be installed by three or more tension lines 110*a* without the use of rigid structures. Many varieties of methods and shapes of the vector propulsion attachment could be used.

The tensioning lines in the first illustrated embodiment are made out of a nylon cord material; however, polyester cord, high-modulus polyethylene fiber (Spectra), para-aramid (Kevlar), synthetic fiber, cotton fiber, elastic cord, metal wire and/or plastic synthetic cordage may also be employed to secure the propulsion frame 115 and vector thrust control unit 116 to the kite frame.

Figure 5:
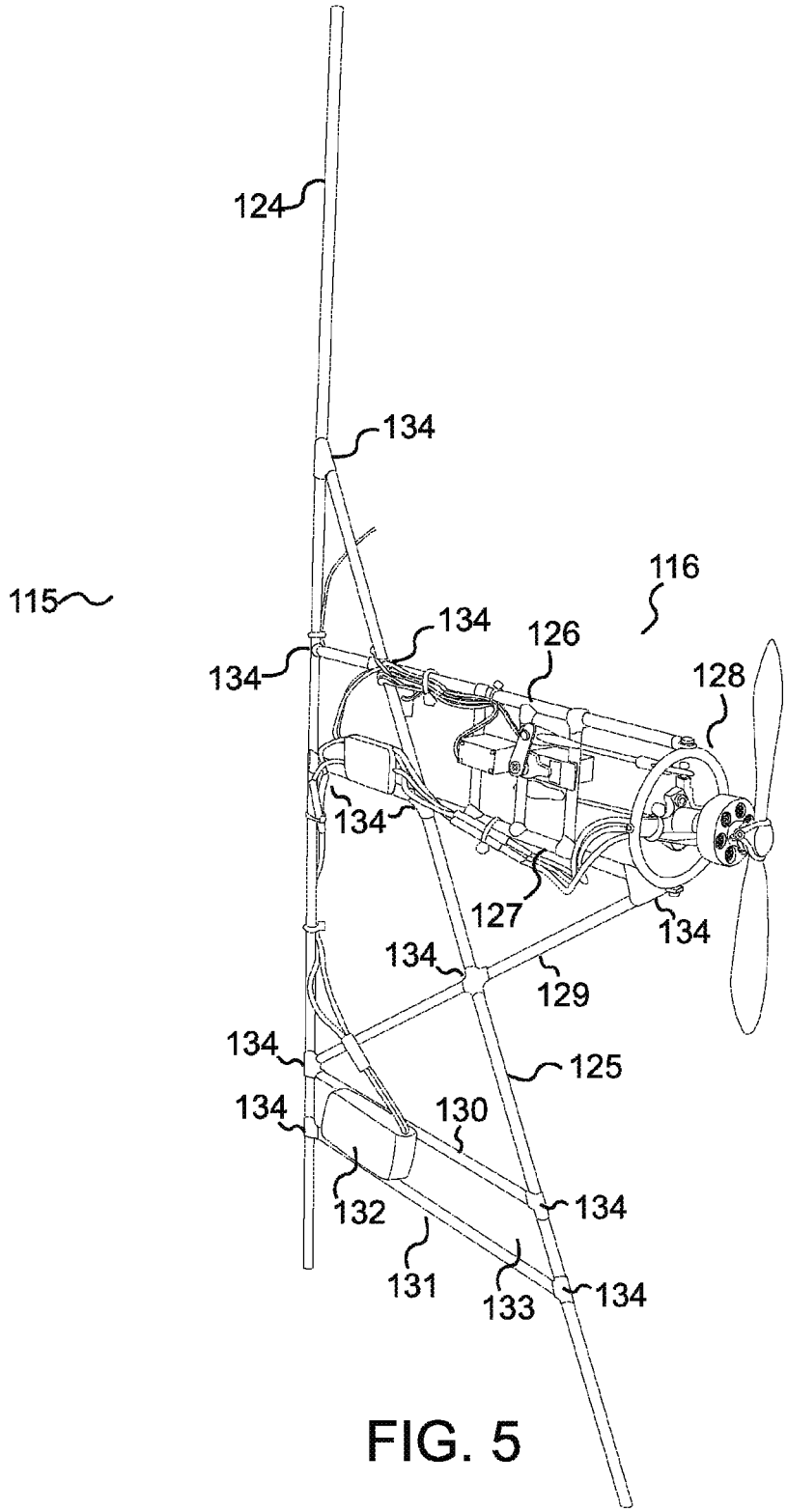
FIG. 5 is a perspective view and side view of the propulsion frame with the vector thrust control apparatus.

As indicated in the embodiment illustrated in FIG. 5, the propulsion frame 115 consists of a vertical framing strut 124, a diagonal framing strut 125, two gimbal mounting struts 126, 127 for the gimbal 128, a stabilizing strut 129 to brace the gimbal 128, motor and servos on the propulsion frame, and two frame stabilizing struts 130 and 131 that serve to support battery 132 and battery Velcro mount 133 ("Velcro" is a recognized trademark intended to refer to hook and loop fasteners). In the present embodiment, the vertical framing strut 124 which is connected to diagonal framing strut 125 to form the main structure of the propulsion frame, has ends that connect firmly in the kite-like object. Attached to the vertical framing strut 124 and the diagonal framing strut 125 are two gimbal mounting struts 126 and 127 that serve to support the gimbal mechanism 128. Also in this embodiment, two frame stabilizing struts 130 and 131 are connected to the vertical and diagonal framing struts 124 and 125, further strengthen the propulsion frame 116, and provide a place for the battery 132 and the battery Velcro mount 133. Stabilizing strut 129 is connected to struts 124, 126, 127 and 125 and acts as a structural support for gimbal 128.

The propulsion frame 115 could consist of at least one strut, but typically may include a plurality of struts in many different geometric and structural forms. In another words, depending on the shape of the kite, the propulsion frame 115 may take on different structural forms.

In the embodiment illustrated, the propulsion frame 115 is constructed out of lightweight carbon rod. While lightweight carbon rod may be used, it is also contemplated that the frame may be made out of other man-made materials such as fiberglass, metal, aluminum, plastic and/or natural materials such as wood, bamboo and or any other suitable material (or combination of materials) that may be incorporated onto at least a portion of the frame 115.

In the embodiment illustrated in FIG. 5, the propulsion frame's carbon rod connection points 134 are joined by cyanoacrylate adhesive that is reinforced by carbon strand filaments. The propulsion frame could be connected by other adhesives such as two part epoxy or other evaporative glues. It is also contemplated that the frame could be constructed by molding interconnecting devices out of metal, aluminum, plastic, reinforced plastic and/or other moldable materials such as rubber and/or flexible compounds as well as rigid compounds. Such interconnecting devices can be made out of pressed metal or milled metal such as aluminum, brass, steel, stainless steel or any metal that can be machined or press bent. Such interconnecting devices may be fabricated with convenient receptors for the use of fastening devices such as screws, nuts and bolts, integral locking clips, pop-rivets, wire, clamps and/or cable ties.

In the embodiment illustrated for kite 100 and the embodiment illustrated in FIG. 3, the shape of the propulsion unit frame is based on straight lines and structural triangles. In another embodiment illustrated in FIG. 7, the shape of the propulsion frame 135 is based on triangular curved lines. The overall shape and appearance of the propulsion frame can vary to accommodate different kite shapes.

Figure 6:
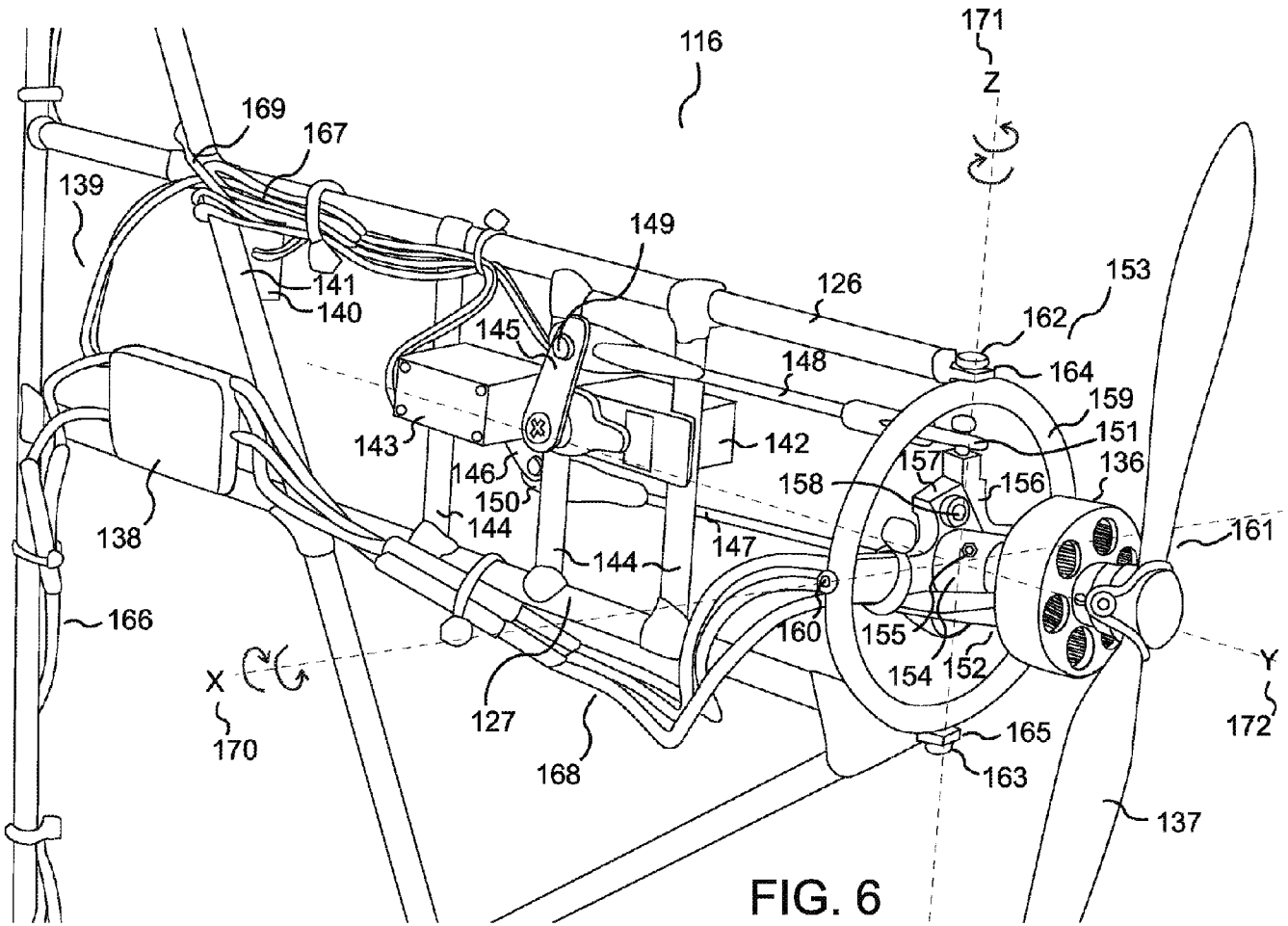
FIG. 6 is a perspective view of the first embodiment illustrating the components of the vector thrust control apparatus.

FIG. 6 illustrates an enlarged view of the vector thrust control unit 116 and includes the motor 136, propeller 137, motor speed controller 138, motor speed controller mount 139, remote control receiver 140, remote control receiver mount 141, two servos 142 and 143, servo attachment mounts 144, servo arms 145 and 146, servo-to-gimbal linkage rods 147 and 148, ball joints 149, 150, 151, 152 (152 is hidden behind motor 136), gimbal 153, motor mount 154, motor mount set screw 155, inner gimbal bracket 156, motor mount attachment plates 157, motor mount attachment plate bolts 158, outer gimbal bracket 159, inner gimbal bracket pivot points 160 and 161 (161 is hidden behind motor 136), outer gimbal bracket pivot points 162 and 163, metal flanges 164 and 165, power and control wires 166, 167, 168, 169, battery 132 (FIG. 5), and battery Velcro mount 133. Finally, 170, 171 and 172 illustrate the rotational axes of the vector thrust control unit 116 as clarified by a standard Cartesian coordinate system whereas: 170 shows gimbal rotational "X"-axis that illustrates the pivoting movement of the inner gimbal mount, 171 shows gimbal rotational "Z"-axis that illustrates the pivoting movement of the outer gimbal ring, and 172 shows "Y"-axis which illustrates a reference line that reflects the centerline of thrust for the vector thrust control unit 116.

Kite and kite-like flying objects need to have some method of adjusting the center of gravity for optimum aerodynamic characteristics. As illustrated in FIG. 5, a Velcro battery mount 133 is included in the propulsion frame 115 and allows the operator to conveniently move the battery 132 forward or backward along the centerline of the said kite or kite-like flying object. Since the battery 132 is one of the heaviest components of the kite, the center of gravity is easily adjusted depending on the needs of the operator and the atmospheric conditions at hand.

In the present embodiment illustrated in FIG. 6, a brushless electric motor 136 is provided and is attached to a plastic propeller 137 that provides the thrust to move and control the motorized kite. As the armature of the electric motor turns with the application of the stored energy in battery 132, the propeller 137 turns and provides the force needed to move the kite in the air. The brushless motor relies on an electronic speed controller 138 to manage and manipulate the stored electricity in battery 132. In the present embodiment, the speed controller 138 is provided with a convenient Velcro mounting platform 139. A brushless electric motor is used; however, it is contemplated that other types of motors could be employed such as brushed electric motors. The present embodiment shows a plastic propeller, which could also be made out of wood, fiberglass, metal, aluminum, carbon composite and/or other rigid materials.

In the present embodiment, a motor mount 154 is provided that connects the motor 136 to the inner gimbal bracket 156. The motor 136 has an annular rear body that slides into a receiving aperture on the motor mount 158 and the motor 136 is secured by a set screw 155. The motor mount 154 has at least one, but may have a plurality of, attachment plates 157 that are connected by common bolts 158 to the inner gimbal bracket 156. Regardless of the exact construction and shape of the motor body, motor mount 158 and inner gimbal bracket 156 all that is required is to have a secure and stable connection between the motor body and the inner gimbal bracket 156. The current embodiment shows an inner gimbal bracket 156 made out of machined aluminum. The inner gimbal bracket 156 could easily be molded or machined out of a ridged material such as plastic, reinforced plastic, metal, steel, aluminum, brass or other materials.

The current embodiment shows a motor-to-inner gimbal connection system comprised of three main parts: the motor 136, the motor mount 154 and the inner gimbal bracket 156. Alternately it is contemplated that the inner gimbal bracket 156 could be fabricated by the means listed above to include an integrated motor mount reducing the said three, parts down to two parts—the motor and the inner gimbal bracket with an integrated motor mount. Alternately it is contemplated that the motor mount 154, and inner gimbal bracket 156 may be an integral part of the motor body thus reducing the said three parts down to one. These additional simplified motor mounting systems could reduce weight, allow faster mass production, and increase reliability. The three part system is merely one embodiment contemplated for use with the present disclosure and other motor mounting systems as mentioned directly above.

In the present embodiment, the inner gimbal bracket 156 is connected to the outer gimbal bracket 159 at two inner gimbal bracket pivot points 160 and 161. The inner gimbal bracket pivot points 160 and 161 are comprised of annular apertures and annular pins or protrusions that allow the inner gimbal bracket 156 to freely rotate within the outer gimbal bracket 159. The inner gimbal bracket 156 should freely rotate inside the outer gimbal bracket 159. The inner gimbal bracket pivot points 160 and 161 are comprised of drilled holes through the outer gimbal bracket 159 and small machine bolts inserted through the outer gimbal bracket 159 that terminate in a secure fashion in the inner gimbal bracket 156. Since the small machine bolts are annular in nature and the holes in the outer gimbal bracket 159 are annular in nature and at a slightly larger diameter than the machine bolts, the entire inner gimbal is allowed to pivot around the inner gimbal "X-axis" 170.

Other methodologies of constructing the pivot points 160 and 161 include, but are not limited to the use of: ball-bearing pivot points, rotational bushings made out of plastic and or fiberglass, carbon, brass, stainless steel, steel, aluminum and or other durable metals or man-made composites. Alternately, the small machine bolt may terminate and be fixed in the outer gimbal bracket 159 and the inner gimbal bracket 156 may have an aperture at both ends that would receive the fixed bolt and thus allow the inner gimbal bracket to rotate inside the outer gimbal bracket 159. This coupling method is simply a reverse of what is mentioned in the present embodiment. Further, it is also contemplated that since the pivot points 160 and 161 do not need to rotate a full 360 degrees to practice this disclosure, semi-rotational but fixed elastic pivots made out of rubber, silicon, nylon and or any strong flexible material may be used as a pivot point.

The outer gimbal bracket 159 is connected to the propulsion frame 115 by outer gimbal bracket pivot points 162 and 163. In the present embodiment, the outer gimbal ring pivot points are installed at the ends of gimbal mounting struts 126 and 127. The gimbal mounting struts 126 and 127 provide a rigid structure to connect the gimbal mechanism 153 into the propulsion frame 115. In the present embodiment, the outer gimbal bracket pivot points 162 and 163 are comprised of annular apertures and pins that allow the outer gimbal bracket 159 to freely rotate within the gimbal mounting struts 126 and 127. In this embodiment, the outer gimbal bracket 159 must freely rotate inside the gimbal mounting struts 126 and 127. Similarly, in the present embodiment, the outer gimbal bracket pivot points 162 and 163 are comprised of drilled holes through metal flanges 164 and 165 located at the ends of the gimbal mounting struts 126 and 127. Small machine bolts are inserted through the top of metal flanges 164 and 165 and terminate in a fixed manner in the outer gimbal bracket 159 at outer gimbal bracket pivot points 162 and 163. Since the machine bolts are annular in nature and the holes in the metal flanges 164 and 165 are annular in nature and a slightly larger diameter than the bolts, the entire outer gimbal bracket 159 is allowed to pivot inside the gimbal mounting struts 126 and 127 according to the "Z-axis" 171. Other methodologies of constructing the pivot points 162 and 163, include, but are not limited to: ball-bearing pivot points, annular bushings made out of plastic and or fiberglass, carbon, brass, stainless steel, steel, aluminum and or other durable metals or man-made composites. In another approach, the small machine bolt may terminate and be fixed in metal flanges 164 and 165 and that the outer gimbal bracket 159 may have an aperture at both ends that would receive the fixed bolt and thus allow the outer gimbal bracket 159 to rotate inside the gimbal mounting struts 126 and 127. Further, it is also contemplated that since the pivot points 164 and 165 do not need to rotate a full 360 degrees to practice this disclosure, semi-rotational but fixed elastic pivots made out of rubber, silicone, nylon and or any strong flexible material may be used as a pivot point.

In the present embodiment the rotational movement of the inner gimbal bracket 156 is modulated by servo 142. A servo is a commercially available device that is electro-mechanical in nature and is commonly used for remote control devices. In the present embodiment, the servo 142 is securely attached to the vector thrust control unit 116 on servo attachment mounts 144. The servo 142, through the input of electrical energy, moves the servo arm 145 in a rotational manner both clockwise and counterclockwise depending on the input by the operator. The rotational energy of servo arm 145 is transferred into reciprocating movement as provided by the servo-to-gimbal linkage rod 148. The reciprocating movement of the servo-to-gimbal linkage rod 148 is transferred to the inner gimbal bracket 156. The servo-to-gimbal linkage rod is connected by swivel joints 149 and 151. The swivel joints 149 and 151 are standard small ball joints common in the remote control hobby industry. In the present embodiment the servo arm 145 is made out of plastic, but could also be made out of metal, aluminum, carbon or fiberglass or any other suitable material. Similarly, servo-to-gimbal linkage rod 148 can be made out of metal, aluminum, plastic, carbon or fiberglass or any other suitable material. The swivel joints 149 and 151 are made out of a combination of plastic and metal, but could also be made out of only plastic or metal or any other suitable material.

In the present embodiment the rotational movement of the outer gimbal bracket 159 is modulated by servo 143. The servo 143 is securely attached to the vector thrust control unit 116 on servo attachment mounts 144. The servo 143, through the input of electrical energy, moves the servo arm 146 in a rotational manner both clockwise and counterclockwise depending on the input by the operator. The rotational energy of servo arm 146 is transferred into reciprocating movement as provided by the servo-to-gimbal linkage rod 147. The reciprocating movement of the servo-to-gimbal linkage rod 147 is transferred to the outer gimbal bracket 159. The servo-to-gimbal linkage rod is connected by swivel joints 150 and 152.

In the present embodiment, servos 142 and 143, each one measures 35 mm×45 mm×29 mm, weighs 29.5 grams and develops 2.6 kg per cm of rotational torque at 6.0 volts. The two servos 142 and 143 are known in the hobby industry as "micro" class servos because of their size and weight. Of course, almost any size or weight of servo could be used.

Figure 1B:
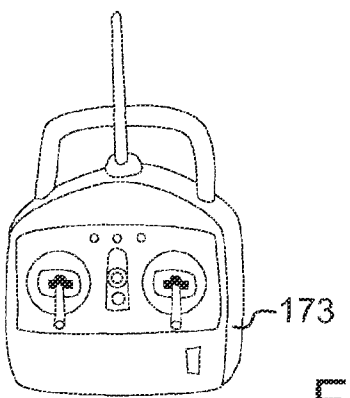

In the present embodiment, control wires 169 and 167 transfer specific amounts of electricity from the remote control receiver 140 to servo 142 and 143. Electrical wires 166 and 168 transfer electricity from the battery 132 to the components on the vector thrust unit. The purpose of the remote control receiver 140 is to receive signals from transmitter 173 (FIG. 1B) and to manipulate the servos 142, 143 to the amounts of movement necessary to control the kite per the input of the operator from the transmitter 173. It is important to note that this patent application is intended to encompass many different sizes and types of commercial or hand built transmitters, receivers and servos.

In the present embodiment, when a motor 136 that is generating thrust through spinning propeller 137 is pointed in a rightward direction, the kite 100 or kite-like object will go left. In the same manner, when the motor 136 that is generating thrust through spinning propeller 137 is pointed in a leftward direction, the kite 100 or kite-like object will go right. When the motor 136 that is generating thrust through spinning propeller 137 is pointed down, the kite 100 or kite-like object will go up. And of course, when the motor 136 that is generating thrust through spinning propeller 137 is pointed up, the kite 100 or kite-like object will go down. The above applies to kites or kite-like objects that place the vector thrust control apparatus in the front of the kite or kite-like object. When the vector thrust control apparatus is placed on the back of a kite or kite-like object, the control becomes opposite. When thrust is applied down, the flying object goes down instead of up as in the case for a front mounted vector thrust control apparatus. When thrust is applied right, the kite goes right.

In a rear mounted vector thrust control apparatus, when the thrust is applied right, the kite's tail rotates oppositely to the left and then the nose points right and the whole assembly is driven right. In the vernacular of aircraft construction, the front powered arrangement would be considered a "tractor" aircraft and the rear powered arrangement would be considered a "pusher" aircraft. In the present embodiment, the vector thrust control apparatus is acting in the tractor style of propulsion. In another words the vector thrust control apparatus is located in the front of the kite-like object and is pulling the kite-like object as opposed to pushing it. The vector thrust control mechanism may be used to pull a kite-like object or push a kite-like object.

By manipulating the remote signal from transmitter 173, the remote control receiver 140 sends the proper amount of electricity to servos 142 and 143 that move servo arms 145 and 146. The servo arms 145, 146 push servo-to-gimbal linkage rods 147 and 148 back and forth which proportionally adjusts and manipulates the position of the inner and outer gimbal brackets 156 and 159. The movement of the servo-to-gimbal linkage rods 147, 148 causes the gimbal 153 to be proportionally manipulated along the "up-down" "X-axis" 170 and along the "right-left" "Z-axis" 171 or in any combination of the two axis. The propulsion motor 136 and thrust producing spinning propeller 137 are rigidly attached to the gimbal 153 and thus can be moved in any combination of up and down and/or left and right. The propulsion motor 136 and propeller 137 provide the means of thrust to move the kite or kite-like object forward and the gimbal mechanism 153 can be controlled up or down and/or left or right to direct the flow of the thrust emanating from the propulsion motor. The direction of thrust is what controls the kite or model aircraft up or down or left or right or any combination in-between. The propulsion motor's rpm usually, but not always, can be varied in amount to allow fast or slow speeds or slower or faster turning.

Since the direction of thrust can be manipulated, the kite or kite-like object can be powered forward into the wind with the nose of the flying object pointing downward and thus offsetting the normal tendency of a kite to simply stall with nose upward and being pushed downwind and out of control.

In the vernacular of the model aircraft hobby, ROG (rise off ground) take offs are when the flying object, unassisted by a human or mechanical means, rises off the ground under the object's own power. Aircraft with conventional moving surfaces usually must roll along a smooth surface with wheels or low friction skids to obtain the necessary airspeed to both take off from the ground and for the moving control surfaces to effectively manipulate the flying object. In a vector powered object, the kite or kite-like object can simply lift off the ground by the use of directional thrust. Since there is no need for landing gear and/or wheels and skids, a vector thrust powered kite or kite-like object can be made lighter in weight. Further, since there is no need for the kite or kite-like object to move along a smooth surface for take off, the kite or kite-like object can perform ROG take offs on almost any surface including, but not limited to grass, rough dirt, gravel, high grass and almost any uneven surface.

The present embodiment illustrates only one vector thrust control unit 116, but two or more vector thrust control apparatuses, as illustrated in FIG. 2A, could be secured onboard a single kite or kite-like object to increase thrust, increase control and/or provide the said kite or kite-like object with further abilities than with one unit such as enhanced aerobatics and/or improved speed.

As readily experienced with common gyroscopes, the inertial forces of spinning objects, as in the spinning motor 136 and propeller 137, causes the motor to strongly resist movement along its spinning axis. In light of this, the vector control method is predicated on moving the motor axis to different placements and thus great strain is placed on the directly connected servos that try to overcome the gyroscopic force. The gimbal mechanism 153 has several important advantages than directly coupled servos. First, the gimbal mechanism 153 relieves the stresses of the delicate servo components by bearing the weight of the motor. Second, the gimbal mechanism 153 bears the strain of the propulsion motor 136 and spinning propeller 137 and thus further protects the servo components 142, 143 from these harsh inertial forces as explained above. Also, since the gimbal mechanism 153 bears the strain of the propulsion motor 136 and spinning propeller 137, heavier and more powerful motors and larger propellers may be used on the kite and kite-like objects without breaking the control servos. Second, because larger and stronger propulsion units can be made use of, larger kites and kite-like objects can be built and flown by vector thrust. The gimbal mechanism 153 allows easy replacement of different motors 136 and easy replacement of different servo components 142, 143. Yet another advantage of servo and gimbal structure is that in a crash or impact trauma of a kite or kite-like object, the force of the impact is displaced through the gimbal linkages and causes less damage on the delicate and valuable servos than in a vector thrust mechanism that uses direct contact of the vector thrust components. Further, it is contemplated that servo-to-gimbal linkage rods 147, 148 may be constructed to intentionally break in an accidental crash thus protecting the valuable vector thrust mechanism. Finally, because leverage arms are used as illustrated in servo arms 145 and 146, different degrees of mechanical advantage can be utilized for different proportional movements in control.

Figure 7:
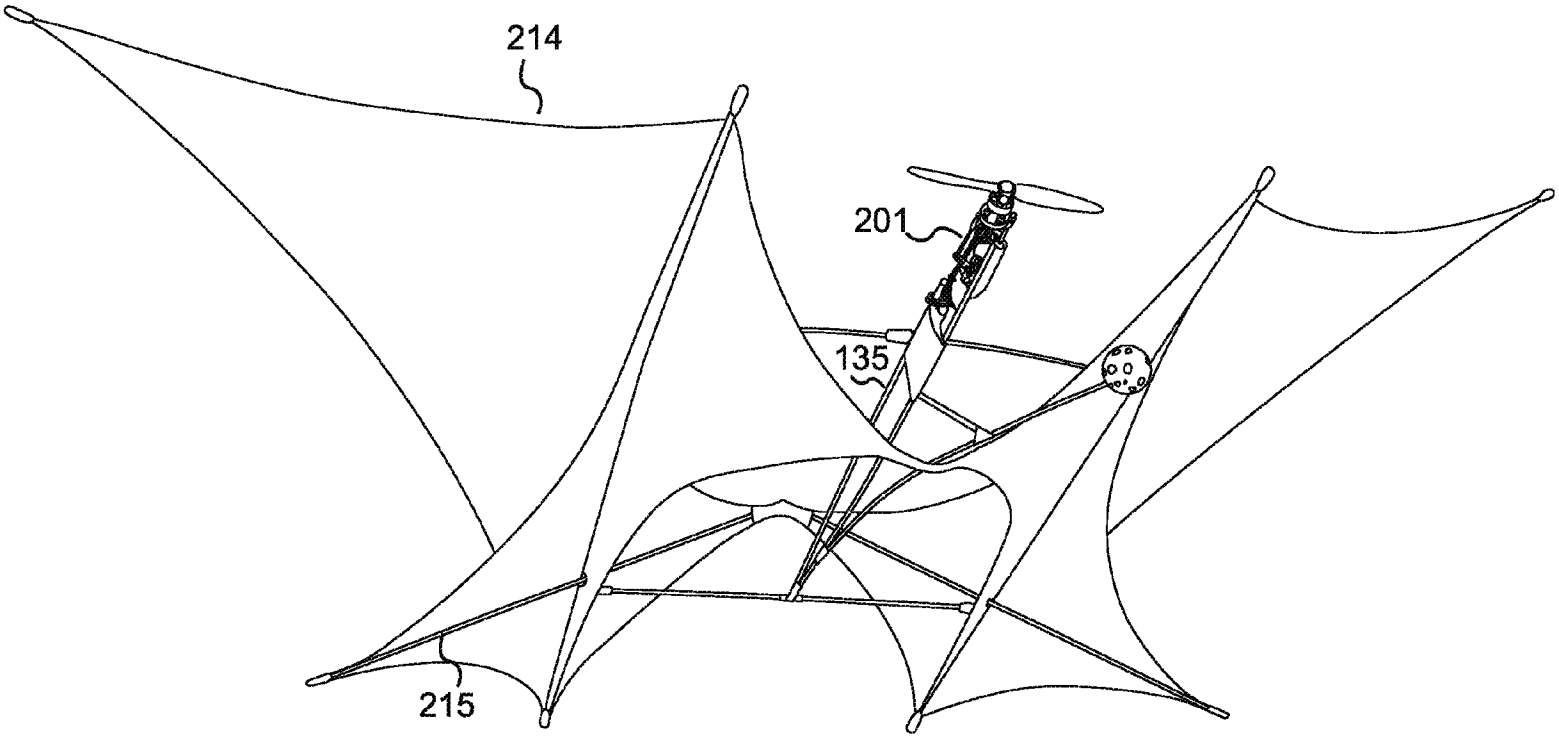
FIG. 7 is a perspective view of an alternative embodiment of the present disclosure in a four wing kite.
Figure 8:
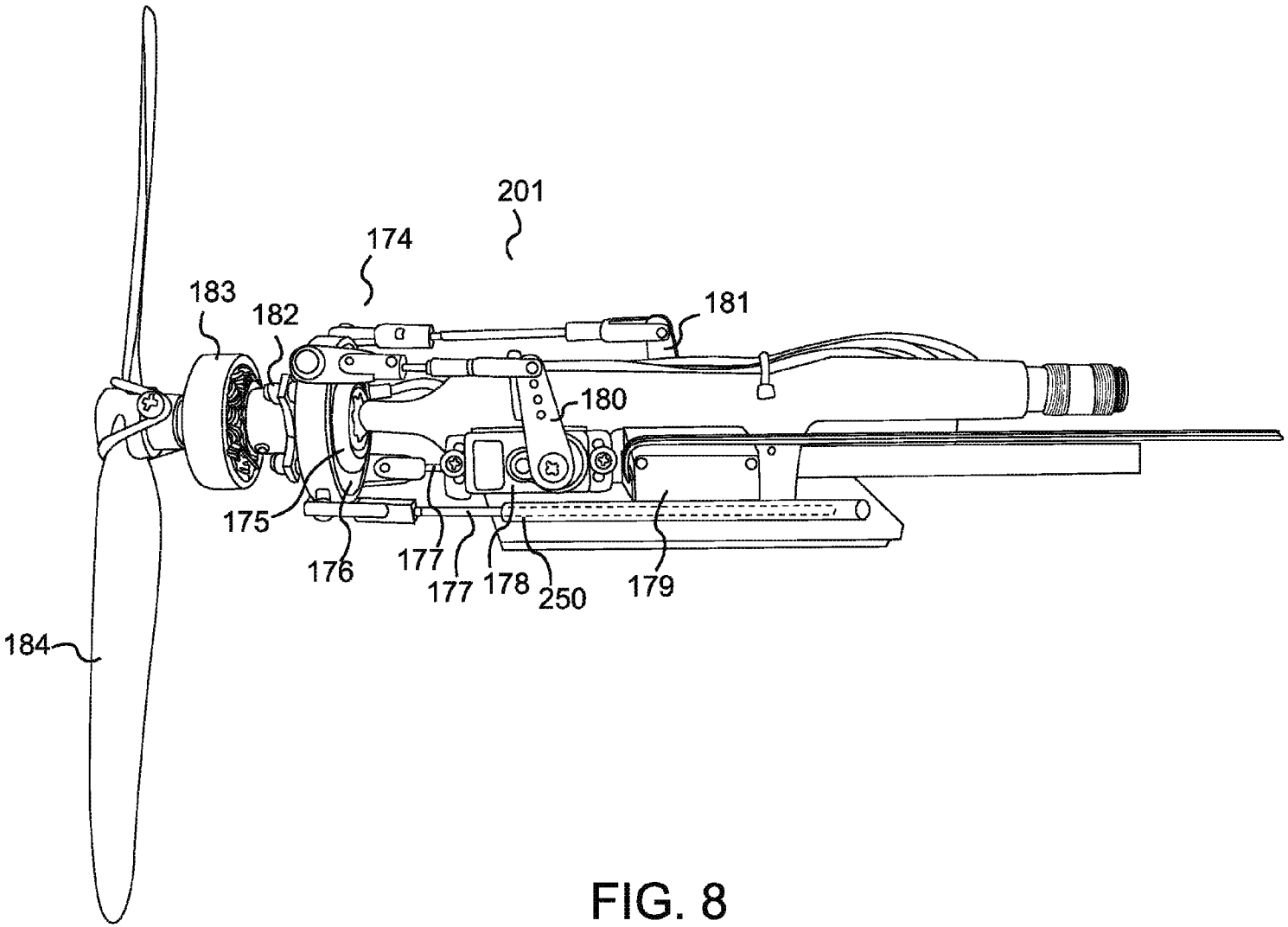
FIG. 8 is a side view of an alternative embodiment of the vector thrust control.

Other shapes and forms of gimbal mechanisms can be employed to fly kites and kite-like objects with vector propulsion. FIG. 7 shows an embodiment of yet another kite or kite-like object 214 and shows kite frame 215, propulsion frame 135 and vector control unit 201. FIG. 8 illustrates a close-up of vector control apparatus 201 and shows an embodiment of another gimbal arrangement. In this embodiment, gimbal 174 is based on a central ball 175 and an attached gimbal ring 176 that is free to move around the ball 175. In this embodiment passive stabilizing rods 177, located in elongated apertures 250, move in a constrained reciprocating path and restrict the gimbal ring 176 to only pivot in the "X-axis" 170 and/or the "Z-axis" 171. The function of the passive stabilizing rods 177 and elongated apertures 250 are to restrict the gimbal ring 176 and attached hardware from rotating around the centerline "Z-axis" 172. The movement of gimbal ring 176 is actuated in a similar manner as gimbal 153 in the first embodiment whereas servos 178 and 179 move servo arms 180 and 181 and in turn create reciprocating motion to pivot the gimbal ring 176 around the "X-axis" 170 and "Z-axis" 171. The gimbal ring 176 is attached to motor mount 182 and the motor 183 is attached to the propeller 184 that provides thrust. In this embodiment of the gimbal 174, (as illustrated in FIG. 8) the gimbal movement around the "X axis" 170 and "Z-axis" 171 is concentrated around one central gimbal ball 175 as opposed to four pivot points as illustrated in FIG. 5 pivot points 160, 161, 162 and 163. In the embodiment as seen in FIG. 8, the same amount of vector propulsion control is achieved in a more compact vector thrust control apparatus 201 and includes simpler method for pivoting the propulsion motor 183.

Figure 9A:
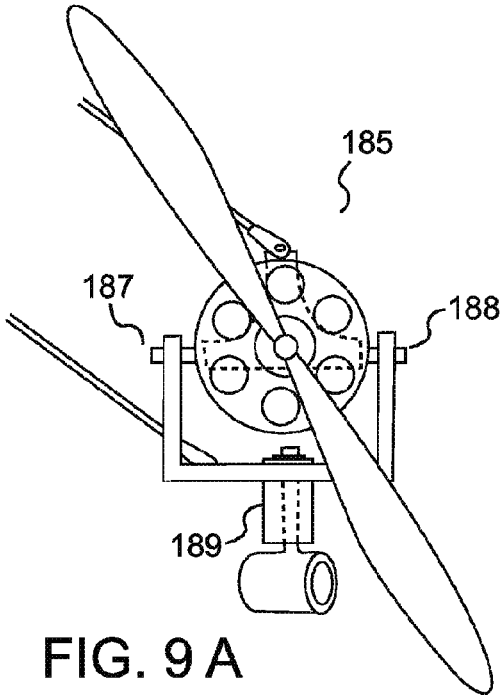
FIGS. 9A-9C illustrate front and side views of different embodiment of the disclosure.
Figure 9B:
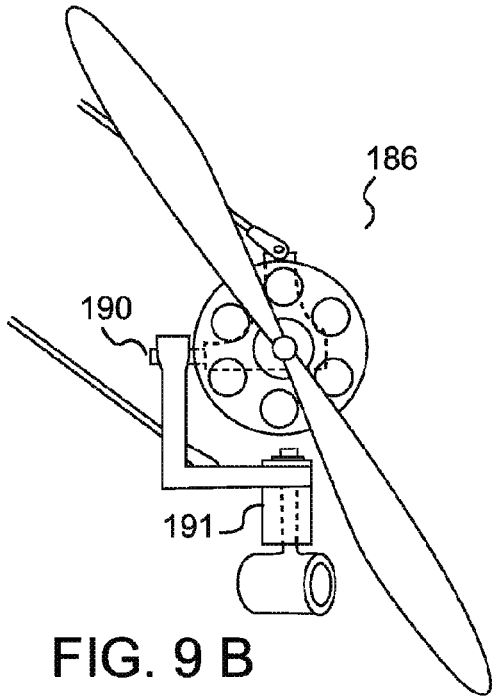
Figure 9C:
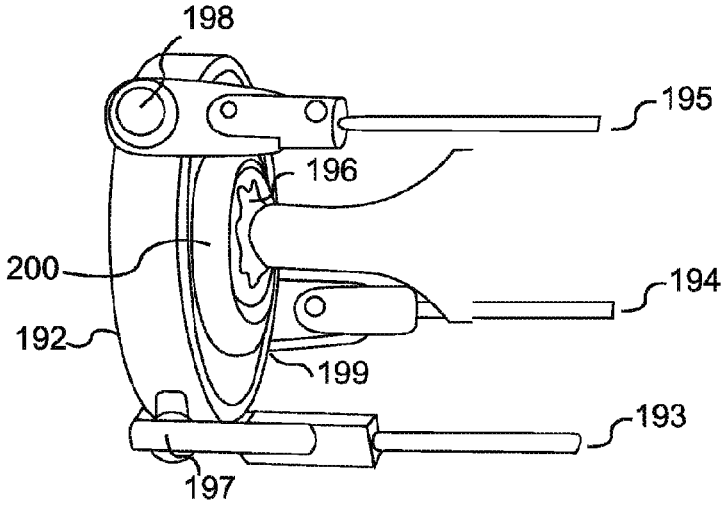

In the first and second embodiments illustrated of the vector thrust control apparatus, the gimbal rotates either on four pivot points or one pivot point to achieve the movement around the "X-axis" 170 and "Z-axis" 171 that enable the practice of this disclosure. Any number from one to four pivot points may be employed. FIGS. 9A-9B illustrate a third 185 and fourth 186 embodiment of a gimbal mechanisms that demonstrate different numbers of pivot points and different positions of pivot points 187, 188, 189, 190, 191. In FIG. 9A, the embodiment includes a bracket and three pivot points. In FIG. 9B, the embodiment includes a bracket and two pivot points. Finally, in FIG. 9C, a single ball gimbal system 192 has been contemplated which uses a single ball 196 is similar to the single ball gimbal described in illustration FIG. 8, except the servo-to-gimbal linkage rods 193, 194, 195 are connected to three points 197, 198, 199 on the gimbal ring 200 and that the three points 197, 198, 199 are arranged at positions 120 degrees from each other around the perimeter of the gimbal ring 200. In such a three point system, all pivotal movements around the "X-axis" 170 and "Z-axis" 171 may be achieved by electronic servo mixing with three active servos. The exact construction and shape of the gimbal can vary from kite to kite or kite-like object to kite-like object, whereas all that is required is that a propulsion motor is supported on or in a kite or kite-like object frame and is free to pivot on both the "X-axis" 170 and "Z-axis" 171 of which axes share a common center line "Y-axis" 172.

FIG. 10 illustrates vector control apparatus 201 that includes a convenient release fitting 202 to allow installation and removal from a propulsion frame 203. The illustrated embodiment has a release fitting 202 that is made out of brass and is similar to a standard pressure hose fitting. There is a typical "male" section 204 and a typical "female" section 205. The operator pulls ring 206 backward on the "female" section 205 which in turn releases the fitting 202 and the vector control unit 201 slides off the propulsion frame. The "male" section 204 stays on the propulsion frame. Illustrations 207, 208 and 209 depict the reverse of the above and as viewed in numerical order, show the vector control unit 201 being connected to the propulsion frame 203.

Figure 10A:
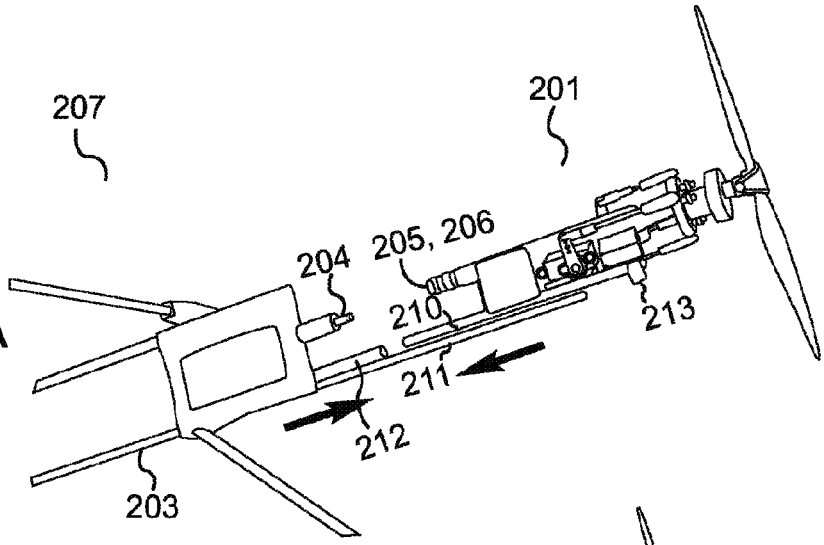
FIGS. 10A-10C are side views of yet another embodiment of the disclosure.
Figure 10B:
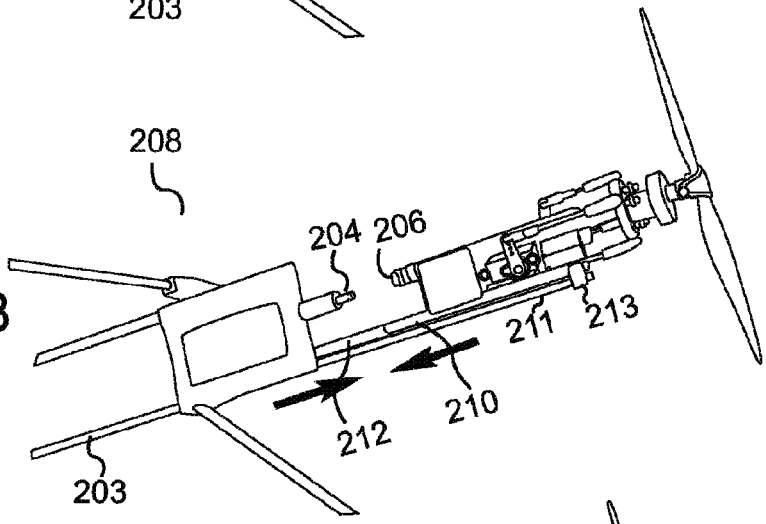
Figure 10C:
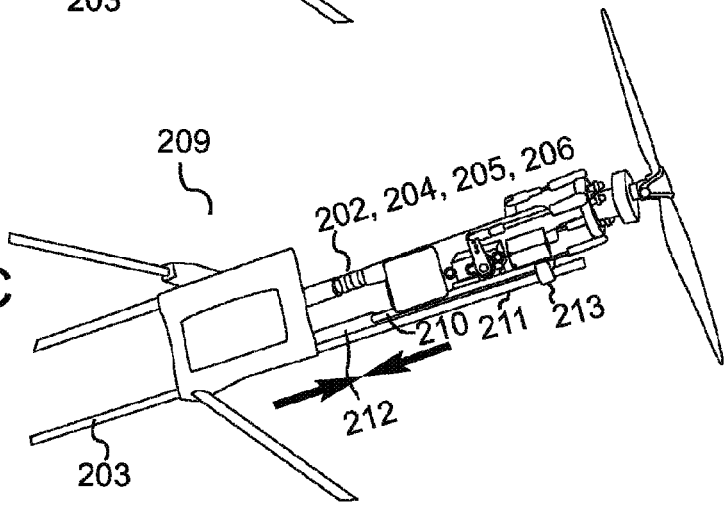

As illustrated in FIGS. 10A-C, receiving protrusions 210 and 211 and receiving apertures 212 and 213 are employed to strengthen the vector thrust control unit 201 in the propulsion frame 203. Although the release fitting 202 as illustrated in the present embodiment is brass, other metals such as but not limited to steel, stainless steel, aluminum and/or plastic or plastic composite may be used In the embodiment illustrated, the release fitting 202 is cylindrical in shape. It should be noted that the cylindrical shape of the release fitting 202 is not required to practice the present disclosure. The release fitting 202 may take on any suitable shape. The number of release fittings is at least one, but could be more. In the present embodiment, the "male" end of the fitting 204 is on the propulsion frame and the "female" part of the fitting 205 is on the vector control unit, and vice versa.

In the illustrated embodiment, the receiving protrusions 210 and 211 and receiving apertures 212 and 213 amount to two receiving pairs. The receiving protrusion 210 and 211 and receiving apertures 212 and 213 may number comprise at least one pair, and may even comprise a plurality of protrusions and aperture pairs. The vector thrust control apparatus 201 may have no receiving protrusions or receiving apertures at all but simply rely on a suitable release fitting that is structurally strong enough to hold the vector thrust control apparatus 201 securely in place.

Vector thrust control apparatus may attach directly to a kite frame as seen in kites 104, 105, shown in FIGS. 2D and 2E, and not necessarily need a propulsion frame to integrate the vector thrust control apparatus. In the case of the canard kite 100 as shown in FIG. 1A, the propulsion frame 115 functions solely to support the vector thrust control apparatus 116 and is not a required structure of the canard kite 100. In yet another example, as in the case of kite-like object 214 shown in FIG. 7, the propulsion frame 135 is an integral member of the kite frame 215 and needs to be installed to give kite 214 its four winged shape. The vector thrust control apparatus is (1) directly attached to a kite frame, or (2) is attached to a propulsion frame whose sole function is to support the vector thrust apparatus, or (3) is connected to a propulsion frame that is integral to the structure of the kite.

The creation of vector thrust control mechanisms that can be easily attached and re-attached to kites and kite-like objects offer advantages. In particular, a single vector thrust control apparatus has the capability to power many different shaped kites and kite-like objects. It has been contemplated that an operator may have only one vector thrust control apparatus that can fit many kites. Thus, one would only need a single vector thrust control apparatus and be able to fly many different styles of kite and kite-like objects.

The propulsion frame 115 on the canard kite 100 could easily be removed out of fittings 113, 114 and tension line 110*a* and the said kite may be flown as a traditional kite with wind and string. Kites, such as kites 104 and 105, which are shown in FIGS. 2D and 2E, and many other possible kite embodiments, have vector thrust control apparatus that easily attach and re-attach to the kite frames without changing the essential structure of the kites, such that these kites may also be flown as traditional kites with wind and string and conveniently be converted back to vector powered kites.

Some successful attempts at flying kites and kite-like objects with vector thrust were achieved by gluing directly together motors and servos to realize the necessary motor movement around the "X-axis" 170 and "Z-axis" 171. The discourse above has described and taught a mechanism for connecting the motor to the servo units through the gimbals described and as illustrated in FIG. 1A, FIGS. 2A through 2F, FIG. 3, FIG. 5, FIG. 6, FIG. 7, FIG. 8, FIGS. 9A through 9C and FIGS. 10A through 10C. On the other hand, with durable enough servos and certain motor combinations, it is possible to achieve successful control of kites and kite-like objects with the direct connection of servo and motor components through the use of a direct bracket system as taught below.

FIG. 11 illustrates a third embodiment of a vector thrust control apparatus in which interconnecting devices are provided for one or more of the connecting points of a vector thrust control unit's servo and motor components comprising of an improved elongated servo arm 216, servo bracket 217 and an improved off-set brace 218 that can be fabricated or molded with suitable apertures and/or receptors that allow the said vector thrust control unit components to be conveniently assembled and disassembled and easily mounted onto a kite or kite-like object.

Such interconnecting devices can be conveniently molded out of metal, aluminum, plastic, reinforced plastic and/or other moldable materials such as rubber and/or flexible compounds as well as ridged compounds. Alternatively, such interconnecting devices can be made out of pressed metal or milled metal such as aluminum, brass, steel, stainless steel or any metal that can be machined or press bent.

Also, such interconnecting devices can be fabricated with convenient receptors for the use of fastening devices such as screws, nuts and bolts, integral locking clips, pop-rivets, wire, clamps and/or cable ties, or with integrally molded pins that are spring enabled and can connect the vector thrust control unit's components together in a convenient manner without secondary fasteners.

Figure 11A:
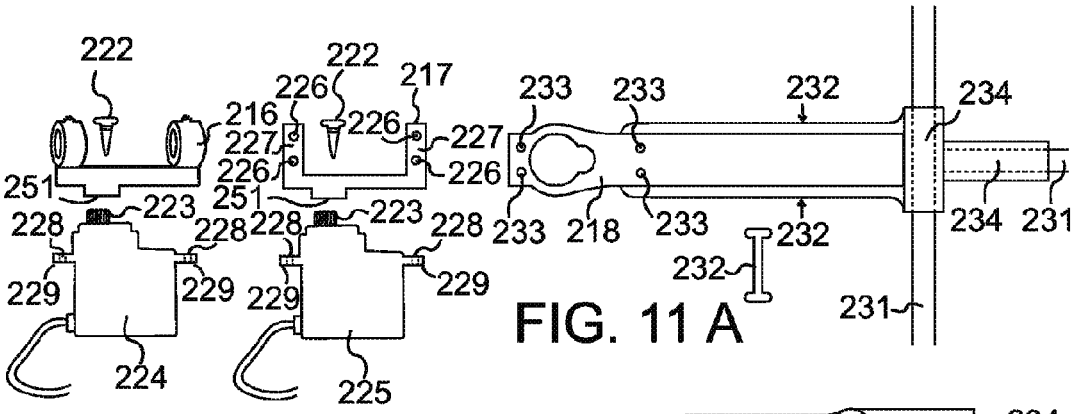
FIGS. 11A-11D are top and side views of another embodiment that illustrates the brackets and connection systems of a direct servo-to-servo, servo-to-motor vector thrust control apparatus.

In another embodiment as illustrated in FIG. 11A, an improved elongated control arm motor bracket 216 has a dimensioned shape to receive the motor body 219 and includes retainer bracket 220 with convenient receptors for set-screws 221. In this embodiment, the elongated control arm motor bracket 216 is typically fastened to the said servo 224 by the standard means of a screw 222 applied to the center of the servo's factory incorporated threaded axle pinion 223. An aperture 251 is provided on motor bracket 216 to exactly match the factory incorporated axle pinion 223.

Also provided is a servo-to-servo bracket 217 that connects the above motor-to-servo assembly 230 with first servo 224 to the second servo 225. In an embodiment illustrated in FIG. 11A, convenient apertures 226 are provided on protrusions 227 that are integral to the servo-to-servo bracket 217 and are made to receive the said servo unit's pre-existing apertures 228 located on the factory incorporated flanges 229 that are provided for the use of fastening devices such as screws, nuts and bolts, integral locking clips, and or pop-rivets. Further, the servo-to-servo bracket 217 is provided with an aperture 251, in the same manner as the aperture in motor bracket 216, to conveniently connect and disconnect servo-to-servo bracket 217 to the servo's factory incorporated threaded axle pinion 223.

In another embodiment of the disclosure, convenient apertures that are integral to the bracket are made to receive the servo unit's pre-existing apertures located on the factory incorporated flanges. In one embodiment, the motor-to-servo assembly 230 is connected to the second servo 225 and servo bracket 217 by simple machine nuts, bolts and/or washers that allow ease of assembly and disassembly. The motor-to-servo assembly 230 may also be connected to the second servo 225 by integrated molded pins located on the bracket that lock into apertures 228 located on the servo unit's factory incorporated flanges 229.

An improved off-set brace 218 connects the motor-to-servo assembly 230 and the second servo 224 to the mounting frame 231 with a pre-measured and integral shape that can be conveniently repeated in production by use of molds and mold casting. (See FIGS. 11B and 11C.) The integral shape of the improved off-set brace's cross section may have curved, rectangular, triangular or any complex molded shapes to provide strength to the off-set brace. In a particularly preferred embodiment, the off-set brace 218 is an "I" beam shape 232.

Convenient apertures 233 are included in the off-set brace 218 for the use of fastening devices such as screws, nuts and bolts, integral locking clips, pop-rivets, wire, clamps and/or cable ties to connect the final servo 225 and preceding vector thrust components 230 to the off-set brace 218. The improved off-set brace is provided with apertures that are so dimensioned to receive and secure the final servo unit's pre-existing apertures 228 located on the factory incorporated flanges 229 with nuts and bolts.

Figure 11B:
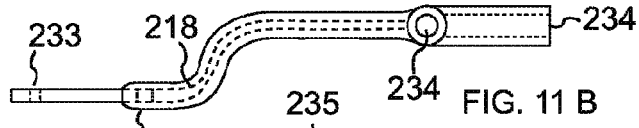
Figure 11C:
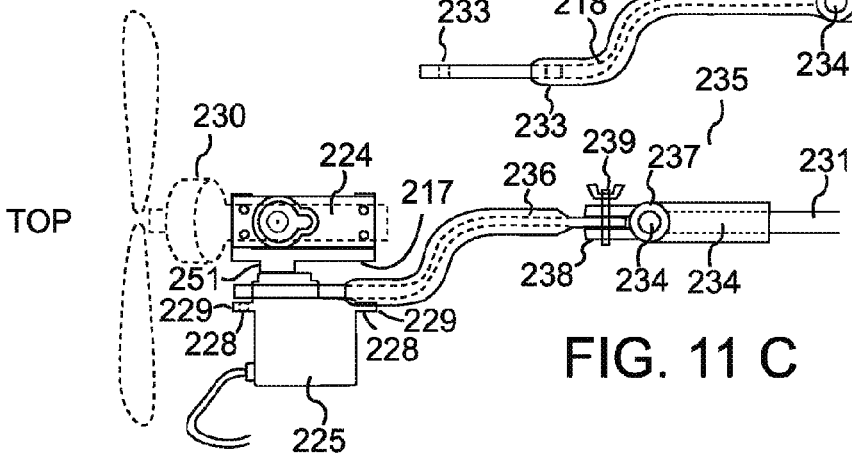
Figure 11D:
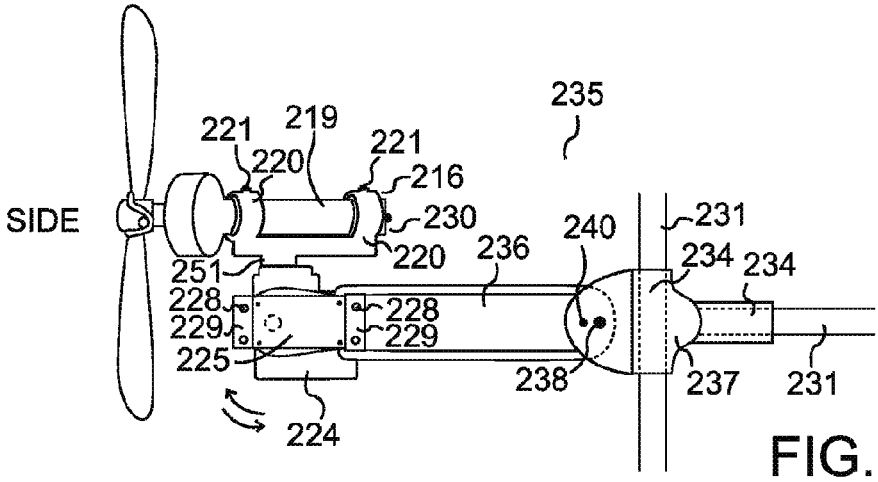

An improved off-set brace with a chamber or chambers are dimensioned to receive one or several struts from the propulsion frame and/or the direct frame of the kite or kite-like object. In the present embodiment as illustrated in FIGS. 11B through 11D, the chamber 234 is elongated and annular. The said chamber's cross section is a function of the various rods incorporated in the support frame. It is contemplated that the cross section may be round, square, oval, multi-sided or any cross sectional shape that fits a suitable kite frame or propulsion frame.

A convenient means of angular adjustment of the off-set brace to the propulsion frame and/or the frame of a kite or kite-like object is shown. Adjusting the fixed angle of the vector propulsion unit from kite to kite allows for improved flying performance and also versatility in vector powering many different types of kites and kite-like objects. As vector propulsion units are switched from kite to kite per the above discourse and as kites are flown in different wind conditions, adjusting and locking in the vector propulsion unit's "X-axis" 170 and "Z-axis" in relation to the centerline "Y-axis" of a kite or kite-like object is important. FIG. 11D illustrates a two part connection system 235 whereas the off-set brace 236 and frame bracket 237 are provided a single connection aperture 238 that allow the two parts to rotate and change angle to each other. The connection aperture 238 allows the off-set brace 236 to be rotated up or down by choice of the operator and locked in by the use of a common threaded "wing nut" style screw 239 or by any type of connection nut and bolt. A single rotating point can be used and the angle locked in by a secondary screw or pin 240. The two part connection system could have spring loaded parts that are adjusted with spring loaded ratchets and/or suitable applied friction to allow the operator to adjust the off-set bracket angle and lock it in a desired position. The present embodiment shows a frame bracket 237 that has two perpendicular chambers 234 that receive framing material. However, it has been contemplated that frame bracket 237 could include as few as one chamber to receive framing material or a plurality of chambers to receive framing material.

Figure 12A:
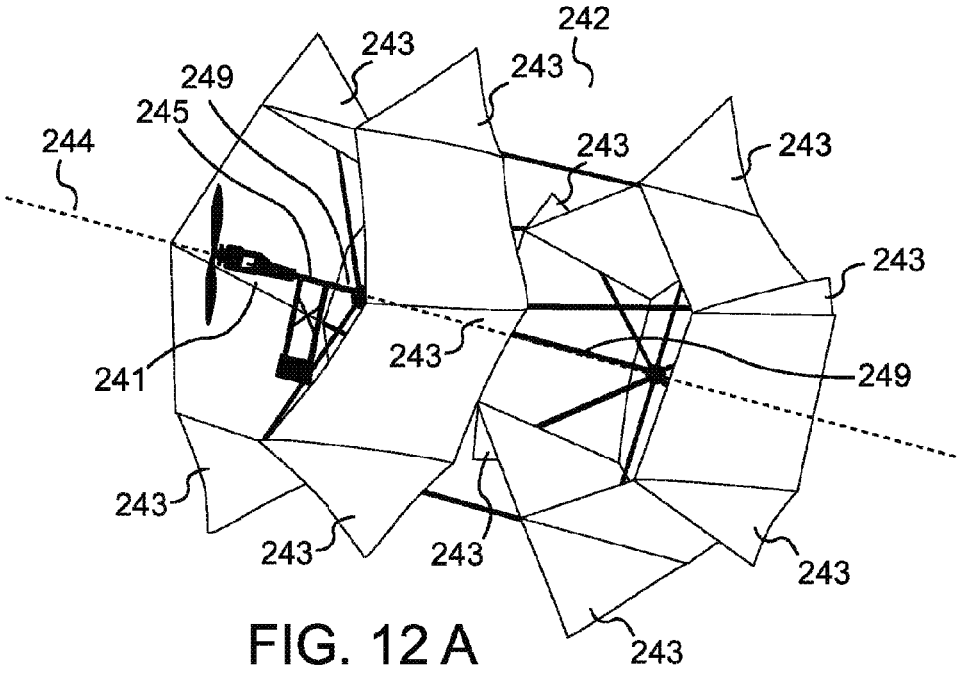
FIGS. 12A-12B are perspective and side views of another embodiment of the disclosure.
Figure 12B:
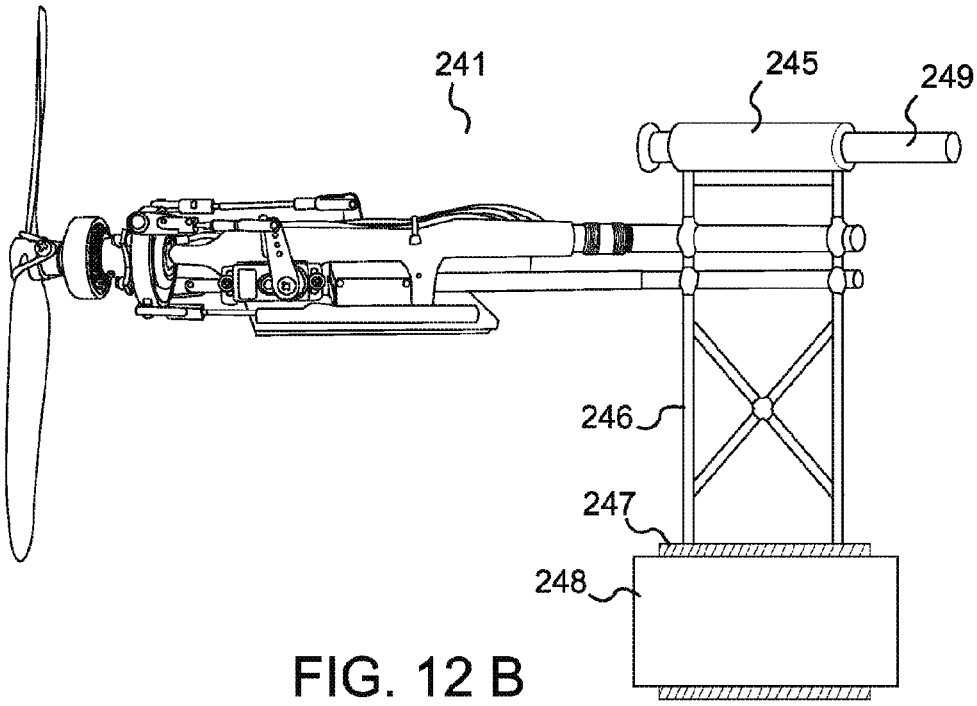

Vector thrust is used to fly and control a rotating kite-like object. FIG. 12B shows yet another embodiment of a vector thrust control apparatus 241 that is mounted on the inside of a rotating box kite 242, which is shown in FIG. 12A. The typical rotating box kite 242 incorporates off-set fins 243 that spin the kite along a center axis 244 as the wind moves across the kite. Needless to say, a conventional vector thrust control apparatus, either direct servo connected or motor gimbal mounted, would be ineffective at controlling a rotating kite if the unit was attached to the kite frame at a fixed point on the frame. This is because as the kite rotates, the entire vector thrust control system would rotate and would be randomly changing thrust angles with relation to the "X-axis" 170, "Z-axis" 171 and "Y-axis" 172 centerline as described in earlier discourse. In the present embodiment, the rotating box kite 242 is provided with a swiveling connection 245 that is attached to an elongated pendulum frame structure 246 that includes a battery connection point 247 to hold the battery 248 that powers the vector thrust control apparatus. The swiveling connection 245 is also attached to a vector thrust control unit 241. As seen in FIG. 12B, the vector thrust control unit 241 runs parallel to the center rod 249 and perpendicular to the elongated pendulum frame structure 246. The swiveling connection point 245 is allowed to freely rotate on center rod 249 which passes through the centerline of the kite 244. Since the battery 248 carries mass and weight and since it is placed at the end of the elongated pendulum frame structure 246, the pendulum frame structure 246 has a natural gravitational tendency to rotate around the center rod 249 and always keep the pendulum frame structure perpendicular to the earth. Since the pendulum frame structure 246 is rigidly connected to the vector thrust control unit 241, the vector thrust control unit 241 remains at a fixed plane to the horizon and does not rotate with the frame of the rotating kite. Keeping the vector thrust control unit on a pendulum unit retains steady orientation of power through the "Y-axis" 172 centerline and elegantly allows the operator to effectively fly and control such a kite as it continuously rotates through the air.

In the present embodiment, the composition of the rotating box kite 242, elongated pendulum frame structure 246 and vector thrust control unit 241 are comprised of the same materials as described above work, sail work and other mechanisms and are not intended to be limited only to the shapes and materials of the featured embodiments. The swiveling connection 245 is made of hollow fiberglass rod, carbon, plastic, nylon, metal, aluminum or any suitable material that could be fashioned into an annular aperture that would allow the outside material or materials to rotate around the said aperture. It is also contemplated that a bearing devise could be used to allow lower friction for the rotating connection. It is important to note that the elongated pendulum frame and swiveling connection may be used with either the gimbal method of vector propulsion for kites and kite-like objects and/or the method and structure described that involves direct servo to motor connections. The elongated pendulum frame may be used with any vector propulsion unit that incorporates a convenient attachment and re-attachment fitting(s).

Figure 13:
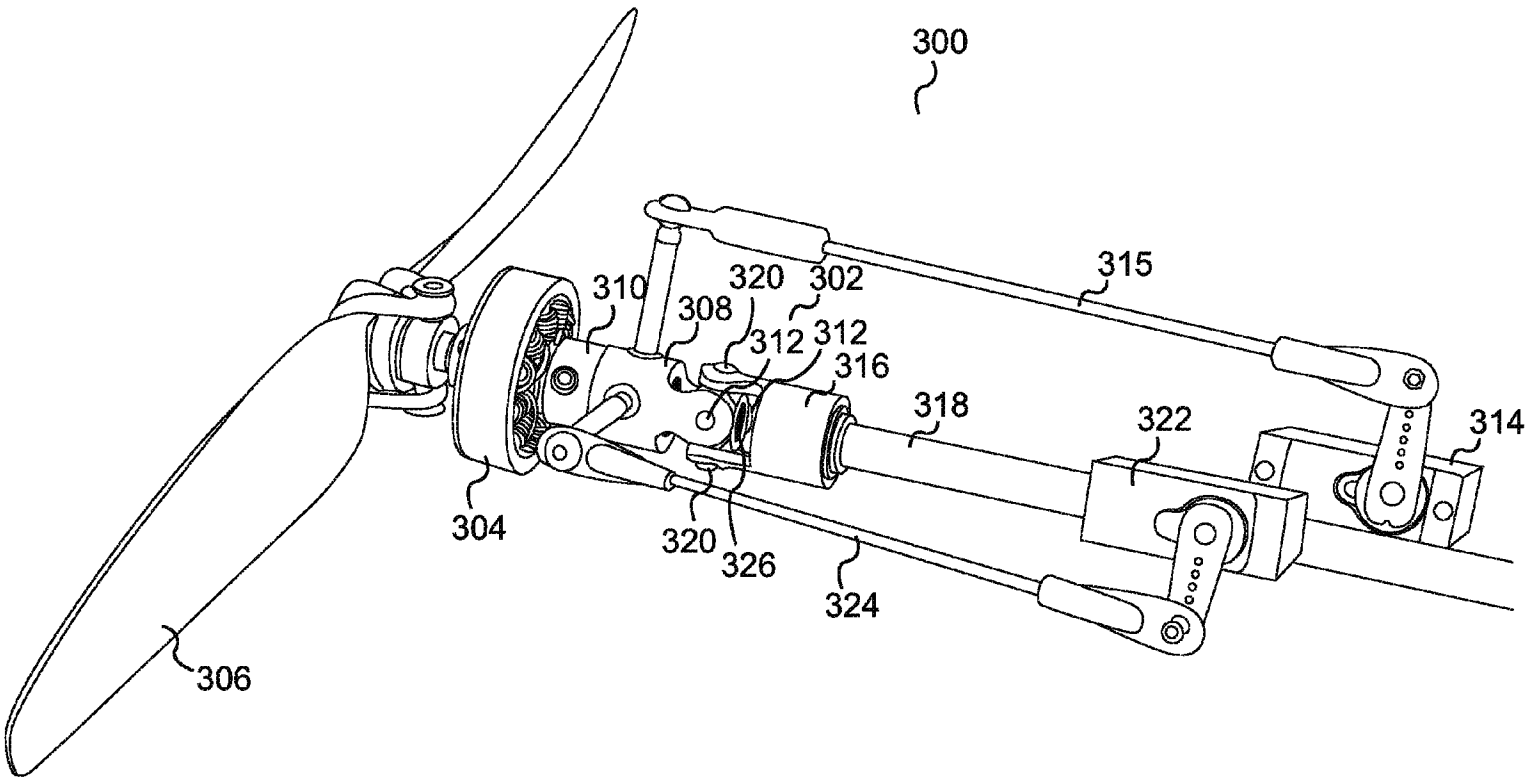
FIG. 13 is a perspective view of a further embodiment of the vector thrust control apparatus of the present invention.

FIG. 13 illustrates another embodiment of a vector thrust control apparatus 300 in which a multi-pivoting bracket 302 is placed behind the motor 304 and propeller 306. The multi-pivoting bracket 302 is able to pivot right and left (as seen in FIG. 6 on the "Z-axis" 171) and also pivot up and down (as seen in FIG. 6 on the "X-axis" 170) and any combination in-between.

The multi-pivoting bracket 302 is composed of three main components. First is the up-down bracket 308 which, in the present embodiment, functions to hold the motor mount 310 and includes at least two apertures to act as pivot points 312. The pivot points 312 enable freedom of movement up and down when activated by the up-down servo 314 and the up-down servo push-rod 315. The up-down movement of the motor guides the direction of the motor's thrust as specified by the operator. In the present embodiment, the up-down bracket 308 is made out of plastic. It is known to the inventors that other materials for the up-down bracket 308 such as reinforced plastic or metal would be suitable for this component and would still remain within the intended scope of the present invention.

The second component of the multi-pivoting bracket 302 is the left-right bracket 316. In the present embodiment, the left-right bracket 316 functions to hold the multi-pivoting bracket 302 into the frame 318 of the vector control apparatus 300. The left-right bracket 316 includes at least two apertures to act as pivot points 320. The pivot points 320 enable freedom of movement left and right when activated by the left-right servo 322 and the left-right servo push-rod 324. This in turn allows the motor 304 and thrust generated by the motor 304 to go left and right. In the present embodiment, the left-right bracket 316 is made out of plastic. It is known to the inventors that other materials for the left-right bracket 316 such as reinforced plastic or metal (including aluminum) would be suitable for this component and would still remain within the intended scope of the present invention.

At the center of the multi-pivoting bracket 302 is the cross axle 326. The cross axle 326 connects the left-right bracket 316 and up-down bracket 308 by means of four pivotal points in two groups 312, 320 that allow freedom of movement up and down, left and right and all combinations of up-down and left-right movement of the motor 304. In the present embodiment, the cross axle 326 is made out of brass. It is known to the inventors that other materials for the cross axle 326 such as reinforced plastic and/or other types of metals (including aluminum) would be suitable for this component and would still remain within the intended scope of the present invention.

It is important to note that the multi-pivoting bracket 302 does not allow twisting rotational movement of the motor 304 in relation to the frame 318 of the vector thrust control apparatus 300 around the center point of the "Y-axis" 172 (which is designated in FIG. 6). In other words, although the multi-pivoting bracket allows the motor to rotate up and down and left and right and any combination in-between, it does not allow the motor to adversely twist in relation to the control servos 322, 314 attached to the frame 318 of the vector thrust control apparatus 300. This is an important feature because twisting movement of the motor 304 and motor mount 310 in relation to the servos 322, 314 and servo arms 324, 315 interferes with the effective articulation of directional thrust.

In FIG. 8 the gyratory group is based on a central ball 175 and an attached gimbal ring 176 that needs passive stabilizing rods 177 to eliminate unnecessary twisting around the frame 318 of the vector thrust control apparatus 300. Although the described passive stabilizing rods 177 and elongated apertures 250 are a working solution to eliminate adverse twisting movement around the "Y-axis" 172 (as seen in FIG. 6), the gyratory group taught in FIG. 13 does not need passive stabilizing rods 177 or elongated apertures 250 because the multi-pivoting bracket 302 only allows pivoting movement in the left-right and up-down positions. It is know by the inventors that the multi-pivoting bracket 302 eliminates adverse twisting around the "Y-axis" 172 without the need for extra stabilizing struts or apertures and, thus, offers some advantages of weight reduction and mechanical simplicity.

Figure 14:
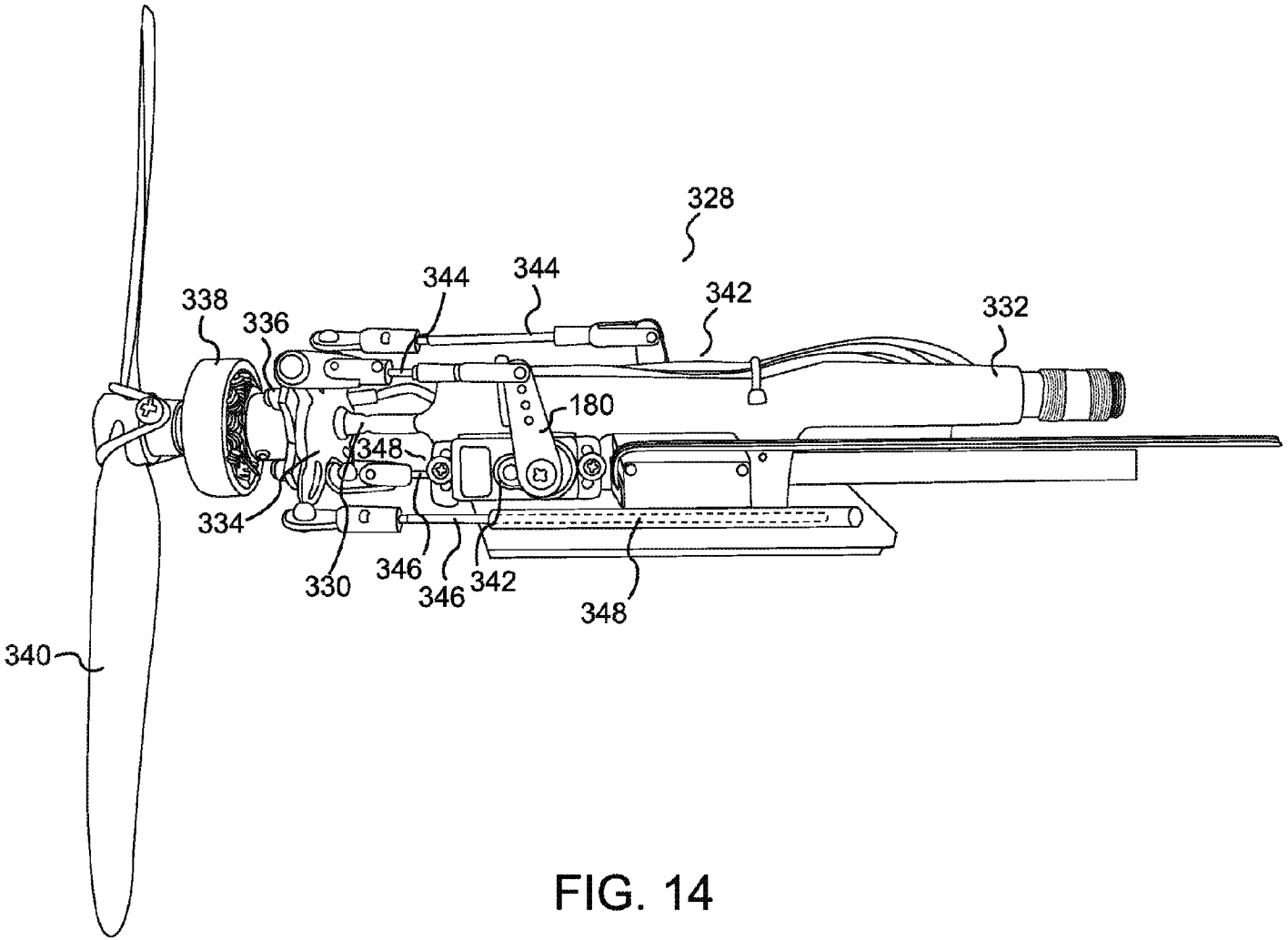
FIG. 14 is a side view of another embodiment of the present invention.

In yet another embodiment illustrated in FIG. 14, a vector thrust apparatus 328 is described in which a flexible connector 330, also referred to as an elongated flexible material, is substituted for the central ball 175 as shown in the vector thrust apparatus 201 in FIG. 8. In this embodiment, the elongated flexible material 330 is made out of a flexible rubberized tube. However, other materials such as flexible plastic or other synthetic or natural flexible materials could be used and still fall within the scope of the present invention. In this embodiment, the elongated flexible material is an annular tube. However, it has been contemplated by the inventors that many other shapes such as square, hexagonal, octagonal, polygonal or ovoid could be used, in either a solid or hollow form, and still fall within the scope of the present invention.

The elongated flexible material 330 in the vector control apparatus 328 is, at one end, connected to the vector control apparatus frame 332 and, at the other end, connected to the control flange 334 and in turn to the motor mount 336. The motor mount 336 is connected to the motor 338 and in turn to the propeller 340. When the servos 342 move the servo arms 344, the elongated flexible material 330 allows the control flange 334, the motor mount 336, the motor 338 and the propeller 340 to move to the direction as prescribed by the operator. Since the elongated flexible material is flexible in all directions in relation to the "X-axis" 170 and "Z-axis" 171 (FIG. 6), the vector control apparatus 328 is able to direct thrust in directions up and down, right to left and any combination in-between. A vector control apparatus using such an elongated flexible material offers advantages in light weight and mechanical simplicity especially in the construction of smaller vector power units for smaller kites and aircraft.

In the vector control apparatus 328, passive stabilizer rods 346 and elongated apertures 348 are used to prevent adverse twisting movement between the vector control apparatus frame 332 and the control flange 334. Although, in the present embodiment, the vector control apparatus 328 passive stabilizer rods 346 and elongated apertures 348 are annular in shape, other shapes have been contemplated such as square, polygonal and ovoid. It has also been contemplated by the inventors that the passive stabilizer rods 346 and elongated apertures 348 could be two reciprocal shapes that are not a closed tubular channel as in the case with the elongated apertures 348, as shown in the present embodiment, but slide by the means of a semi-closed channel and a reciprocal track. Whether the elongated apertures are open channels or closed tubular channels, both methods could be used. Moreover, both embodiments are intended to fall within the scope of the present invention.

As noted above, the embodiment shown in FIG. 14 also shows a vector control apparatus with two passive stabilizing rods 346 that are stabilized inside two elongated apertures 348. While this is the suggested number of stabilizing elements for control flange 334, it should be noted that only one stabilizing element is needed to practice the present invention. One stabilizing element or any number above a single stabilizing element may be used to prevent adverse twisting of the control flange in relation to the frame of the vector control apparatus. It is also contemplated that a larger number of stabilizing elements may be employed without departing from the scope of the present invention.

In the embodiment encompassing the vector control apparatus 328, the control flange 334 is made out of plastic however it has been contemplated by the inventors that other materials such as metal, aluminum, fiberglass, carbon, reinforced plastics or a mixture of natural and synthetic materials could be used and still fall within the scope of the patent. In the embodiment illustrated in FIG. 14, the motor mount 336 is made out of metal. However, it has been contemplated by the inventors that other materials such as fiberglass, carbon, reinforced plastics or a mixture of natural and synthetic materials could be used and still fall within the scope of the present invention.

It has also been contemplated by the inventors that the control flange 334 and the motor mount 336 could be molded, machined or constructed as one integral component as opposed to two or more pieces. Of course, as would be appreciated by those skilled in the art, the control flange 334 and motor mount 336 may be a single element without departing from the intended scope of the present invention.

It has also been contemplated by the inventors that the control flange 334 may be constructed as an integral part of the motor housing for advantages of lighter weight and/or mechanical simplicity. Regardless of whether the control flange 334, motor mount 336 and motor 338 are comprised of a plurality of components or one single component, what is required to practice the present invention, among other features, is that the movements of the control servos 342 are able to directly articulate reciprocating movement to the thrust motor.

Figure 15:
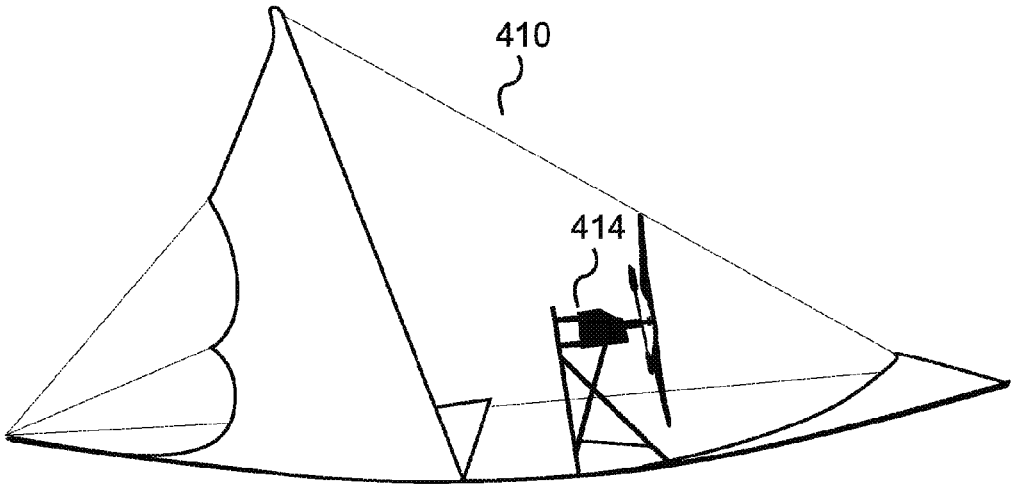
FIG. 15 is a side view of a motorized kite-like object according to still another embodiment of the present invention.
Figure 16:
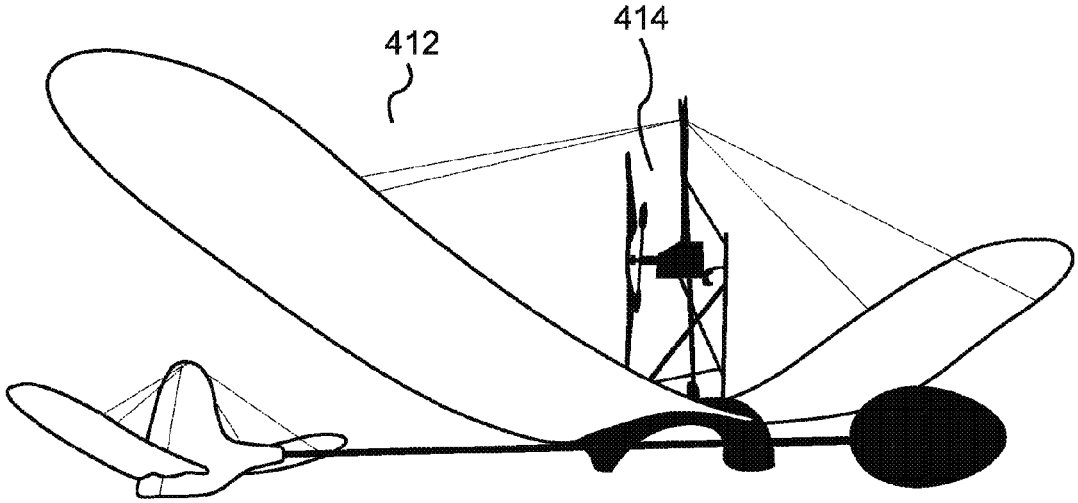
FIG. 16 is a side view of one additional embodiment of the kite-like object of the present invention.
Figure 17:
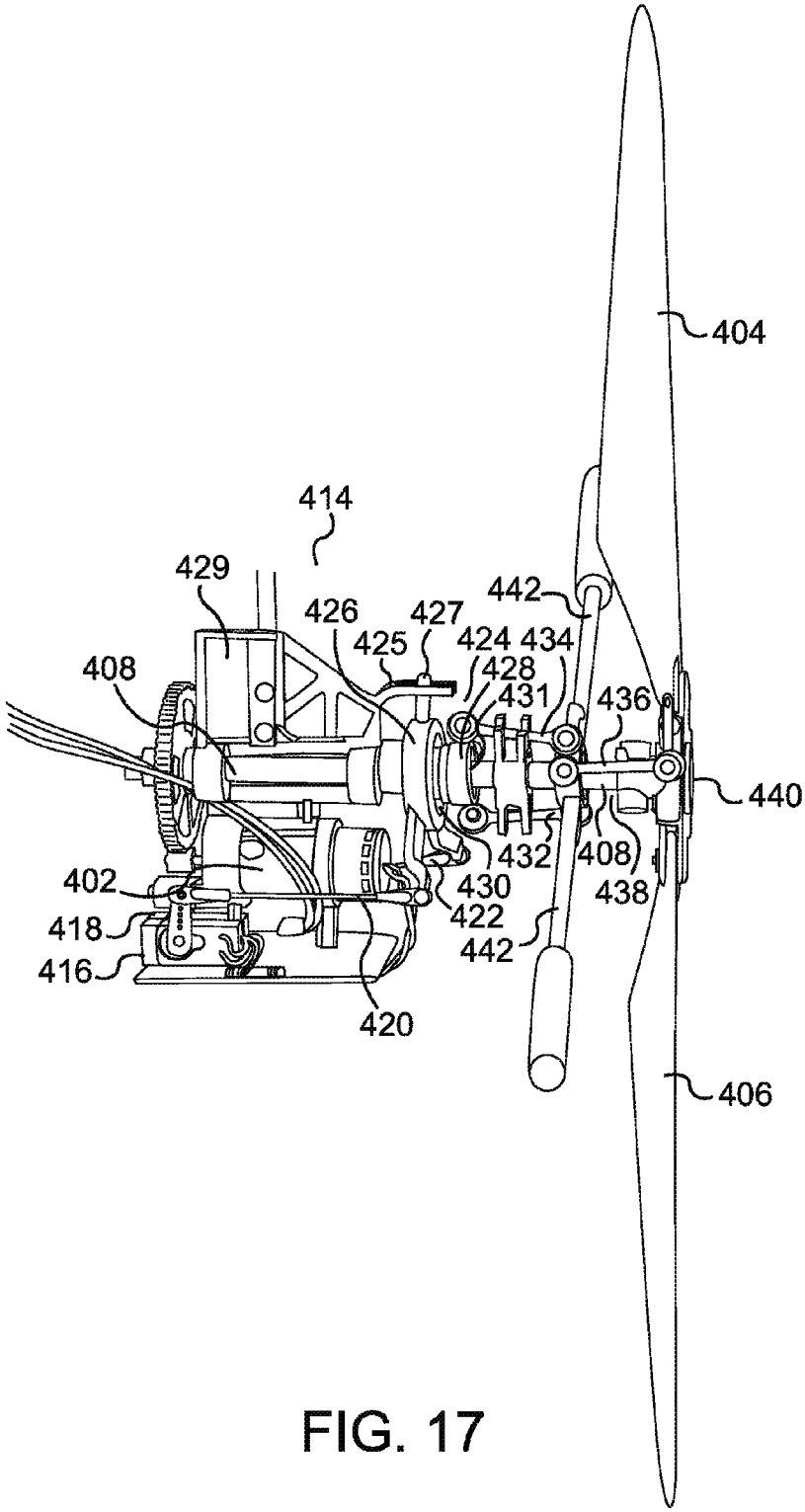
FIG. 17 is a side view illustration of a thrust control apparatus of the present invention involving cyclic pitch modulation.

FIG. 15, FIG. 16 and FIG. 17 illustrate another embodiment of the present invention whereas a novel method of cyclic pitch modulation is taught to direct thrust from a kite or kite-like aircraft. The discussion of the present invention, above, detailed several methods of directing thrust by manipulating a motor positioning in a gyratory group.

It is also known to the inventors that it is possible to have a stationary motor 402 that provides a stationary spinning power source, whereby thrust direction is controlled by the means of manipulating the angle of attack of the propeller blades 404, 406 as they revolve around a fixed central axle 408 and as the axle is mounted in a horizontal manner in relation to a kite-like object.

FIG. 15 and FIG. 16 depict two different kite-like objects 410 and 412 that employ a vector thrust apparatus 414 using cyclic pitch modulation.

Object 410 is a kite-like object designed in a Canard style, and object 412 is a kite-like object that resembles a traditional aircraft. It is known by the inventors that many different kite-like shapes may be flown and controlled with the present invention. In other words, the overall shape and appearance of the kite-like flying object may encompass many different structures and forms that are not critical to the practice of the present invention.

It is known in common propeller design that changes in blade pitch results in changes in thrust. As all blades on a propeller increase their angle of attack, thrust also increases. The thrust increase and decrease is directly proportional to a propeller's increase and decrease in the angle of attack, or pitch, until the angle of attack is too great or too small to provide effective lift in relation to the cross section of the propeller blade. In the vernacular of helicopter rotor technology, this increase and decrease of thrust in relation to all propeller blades combined is called "collective pitch".

Another important term in helicopter rotor technology is "cyclic pitch" modulation. Cyclic pitch modulation refers to the ability to control the angle of attack or pitch of individual propeller blades at any given point around one complete revolution of a central axle. In another words, cyclic pitch modulation is the ability to change each propeller blade's pitch as it rotates around a hub so that all propeller blades will change their angle the same amount at the same point in one rotational cycle. Cyclic pitch modulation allows more or less thrust directed away from any specified point around the circumference of a propeller.

Cyclic pitch modulation allows a kite or kite-like aircraft to be controlled right and left, up and down or any combination in-between.

FIG. 15 and FIG. 16 show a vector thrust control apparatus 414 that uses cyclic pitch modulation on a horizontal axis to control kite-like objects 410 and 412.

FIG. 17 depicts a more detailed view of the present embodiment that illustrates the components of the vector thrust control apparatus 414 that uses cyclic pitch modulation. The servos 416 and 418 manipulate push rods 420 and 422 that, in turn, move swash plate 424 at different angles along the stationary spinning axle 408. The stationary spinning axle 408 is powered by motor 402. It is noted that motor 402 is stationary. The swash plate 424 is able to tilt in all directions and is composed of a non-rotating outer ring 426 with a central ball joint 430 and a rotating inner ring 428 with a central ball joint 431. The non-rotating outer ring 426 does not rotate with the turning axle 408 and is held stationary by the attached outer ring pin 427 that rides back and forth in pin stabilizer 425 which is attached to the stationary frame 429. The center ball joints 430, 431 allow the swash plate to tilt in relation to the stationary spinning axle 408. Linkage rods 432, 434, 436 and 438 allow the tilt of the swash plate to be transferred to the main rotor hub 440. A connected stabilizer bar 442 is shown that, in a typical embodiment, helps to stabilize and dampen any errant gyroscopic forces.

As the linkage rods are moved up and down, the pitch of propeller blades 404 and 406 are changed to create more or less thrust per the directions of the operator. It is the tilt of the swash plate 424 in relation to the stationary spinning axle 408 that is directly linked to the propeller blades 404, 406 and changes the angle of attack of the blades as they revolve through each revolution. Because the swash plate can be tilted at any given point around the stationary spinning axle 408, the propeller blades 404, 406 can be modulated to reflect more or less angle of attack at any given point around one revolution of the propeller blades 404 and 406.

It is, therefore, possible to achieve complete control of a kite-like object by modulating the thrust around the rotational cycle of the propeller blades 404, 406.

FIGS. 18, 19, 20, and 21 show a kite-like object 448 with a cyclic pitch modulation apparatus 443 in various stages of control. The propeller 444 is marked with four points on the rotational circle 446 of the propeller. These represent the four basic quadrants of one rotation. For clarity, they are marked as "12:00", "6:00", "3:00" and "9:00", as reflected in the circular dial face of a standard clock.

Figure 19:
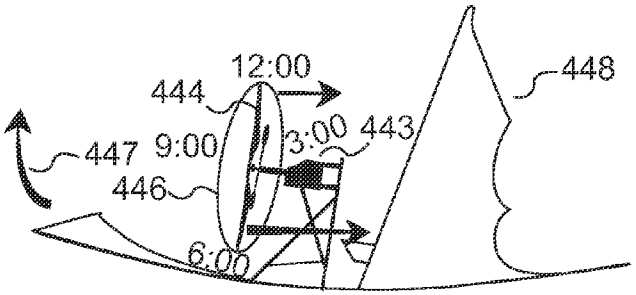
FIG. 19 is a side view illustration of a second contemplated mode of operation of the thrust control apparatus shown in FIG. 17.
Figure 18:
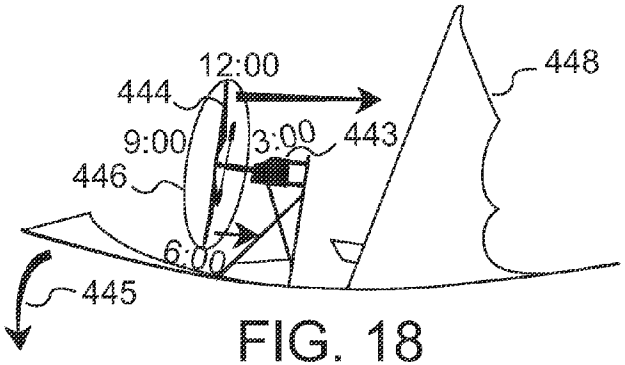
FIG. 18 is a side view illustration of a first contemplated mode of operation of the thrust control apparatus shown in FIG. 17.
Figure 21:
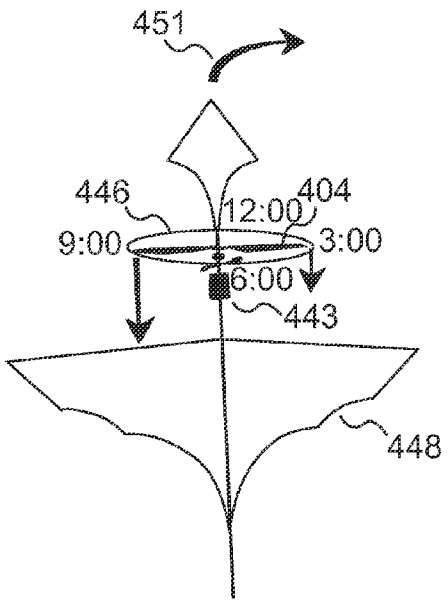
FIG. 21 is a side view illustration of a fourth contemplated mode of operation of the thrust control apparatus shown in FIG. 17.
Figure 20:
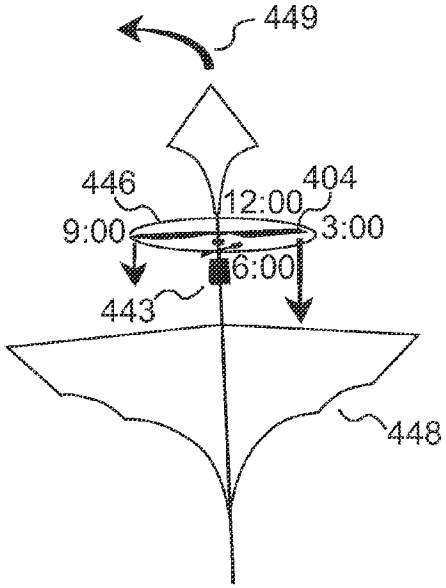
FIG. 20 is a side view illustration of a third contemplated mode of operation of the thrust control apparatus shown in FIG. 17.

As seen in FIG. 18, if more thrust is presented in the "12:00" area of the propeller blades 444, the kite-like object 448 will go down 445. If more thrust is presented in the "6:00" area of the propeller blades 444, as seen in FIG. 19, the kite-like object 448 will go up 447. Similarly, as seen in FIG. 20, if more thrust is presented in the "3:00" area of the propeller blades 444, the kite-like object 448 will go left 449. Consequently, as seen in FIG. 21, if more thrust is presented in the "9:00" area of the propeller blades 444, the kite-like object 448 will go right 451.

As discussed, the vector thrust produced by cyclic thrust modulation is the result of changing the individual blade pitch more and less as it travels around the 360 degrees of the circle. If a certain amount of control input is given to the swash plate 424 for an extended period of time, the same amount of pitch change and pitch recovery will result over and over again as the propeller blades spin around the main rotor hub.

In the present embodiment, vector control apparatus 414 utilizes two propeller blades 404 and 406. While this is the suggested number of propeller blades, it should be noted that only two propeller blades are preferred to practice the present invention. Any number greater than one is believed to be sufficient to produce controlled thrust around the rotational cycle of the propeller blades. Of course, as would be appreciated by those skilled in the art, three, four, five, six or a multiple of separate propeller blades may be employed without departing from the intended scope of the present invention.

In the present embodiment, the vector control apparatus 414 contains components and materials attributed to the micro size class of toy radio control helicopters. As would be appreciated by those of ordinary skill in the art, the vector control apparatus 414 may take on many different sizes, components and materials and still remain within the intended scope of the present invention. In other words, the overall size, components and materials of the vector control apparatus 414 can vary as long as cyclic controlled thrust can be achieved on a horizontal axis as attached to a kite-like object.

Although the present embodiment features vector thrust control through horizontally mounted cyclic pitch modulation, it is known to the inventors that collective pitch modulation may also be employed to augment total thrust levels for the purposes of increasing or decreasing speed or enhancing control of the kite-like object.

As discussed in previous discourse, the embodiment as seen in FIG. 17 features a swash plate 424 that directly manipulates the pitch angles of the individual propeller blades 404, 406.

Figure 23:
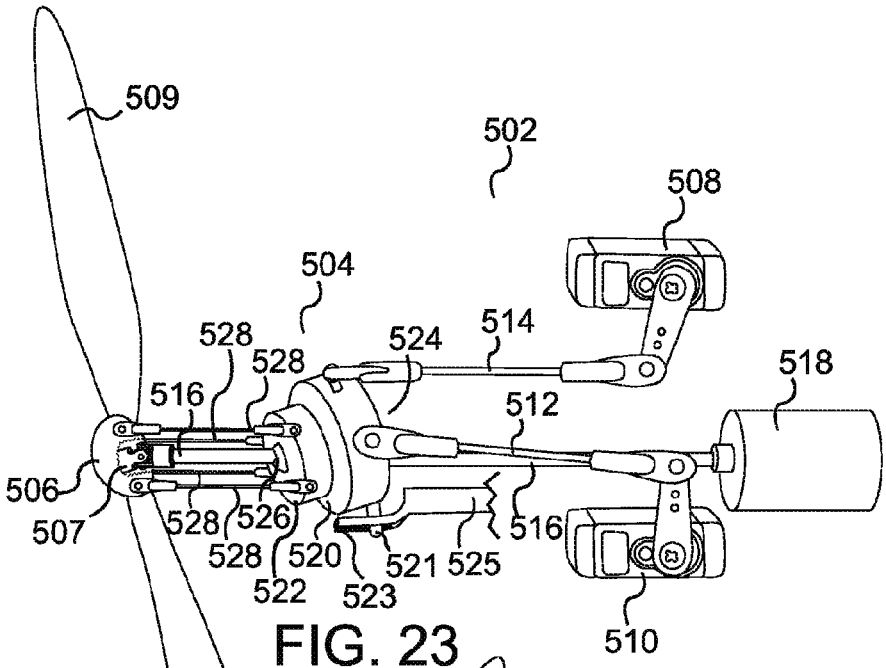
FIG. 23 is a side view of the thrust control apparatus shown in FIG. 22, with the propeller being shown in a different orientation.
Figure 22:
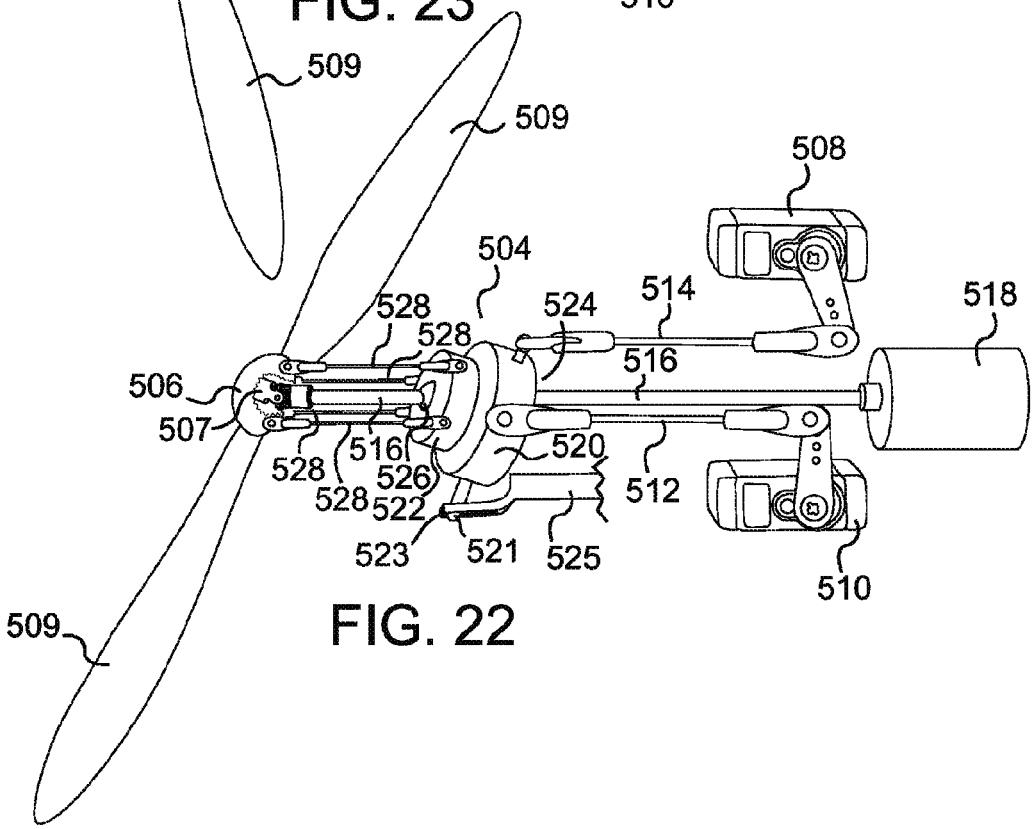
FIG. 22 is a side view of another embodiment of the present invention involving teetering hub modulation.

In yet another embodiment, which is illustrated in FIGS. 22 and 23, a vector thrust apparatus 502 is illustrated in which a swash plate 504 is used to directly manipulate a teetering hub 506.

In this embodiment, which encompasses teetering hub modulation, the servos 508 and 510 manipulate push rods 512 and 514 that in turn move swash plate 504 at different angles along the stationary spinning axle 516. The stationary spinning axle 516 is powered by motor 518. As in the previous embodiments, the motor 518 is stationary.

FIG. 22 demonstrates servo 508 tilting the swash plate 504 upward. FIG. 23 demonstrates the same servo 508 tilting the swash plate 504 downward. FIG. 22 and FIG. 23 show servo 508 manipulating the vector thrust control apparatus 502 along the up/down "X-axis" 170. Servo 510, in the same manner (however not illustrated), serves to move the vector thrust control apparatus 502 in the left/right "Z-axis" 171.

It is noted that, in the embodiment shown in FIG. 22 and FIG. 23, servo 508 and servo 510 have the ability to move the teetering hub 506 up and down and left and right and in any combination in-between. The teetering hub 506 includes a multi-pivoting element 507, which is similar to the multi pivoting bracket 302 described in connection with FIG. 13.

The swash plate 504 is able to tilt in all directions and is composed of a non-rotating outer ring 520 with a central ball joint 524 and a rotating inner ring 522 with a central ball joint 526. The non-rotating outer ring 520 does not rotate with the turning axle 516, but is held stationary by the attached outer ring pin 521 that rides back and forth in pin stabilizer 523 which is attached to the stationary frame 525. The center ball joints 524, 526 allow the swash plate 504 to tilt in relation to the stationary spinning axle 516. Linkage rods 528 allow the tilt of the swash plate 504 to be transferred to the teetering hub 506. The multi-pivoting element 507 is connected to the teetering hub 506 and allows the teetering hub and propellers 509 to tilt up and down, left and right and any direction in-between. As the linkage rods 528 are moved up and down and or left and right, the angle of the teetering hub 506 is directly changed to create different directions of thrust as prescribed by the operator.

In the present embodiment, the multi-pivoting element 507 is similar to the multi-pivoting bracket 302 described in FIG. 13. It is noted, however, that other forms of pivoting connections, such as a metal spring, flexible plastic, rubber, and flexible tubing, have been contemplated by the inventors to be encompassed within the scope of the present invention. Regardless of the exact construction of the multi-pivoting element 507, what is required for the multi-pivoting element, among other features, is that it connects the stationary spinning axle to the teetering hub 506 and propellers 509, and that the multi-pivoting element 507 can spin with the axle 516 and articulate up and down and left and right and combinations in-between through the use of a swash plate 504.

Figure 25:
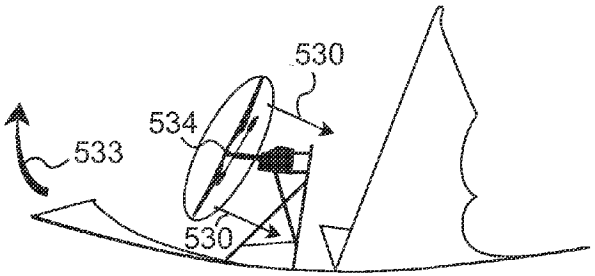
FIG. 25 is a side view illustration of a second contemplated mode of operation of the thrust control apparatus shown in FIGS. 22 and 23.
Figure 24:
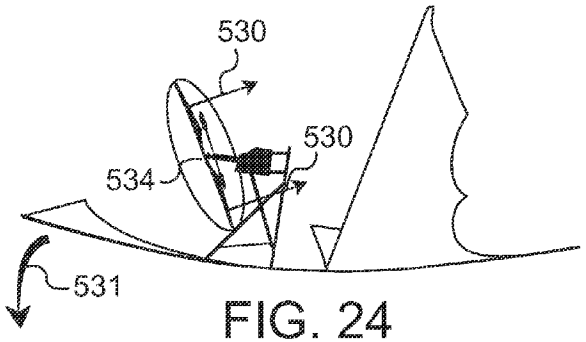
FIG. 24 is a side view illustration of a first contemplated mode of operation of the thrust control apparatus shown in FIGS. 22 and 23.
Figure 27:
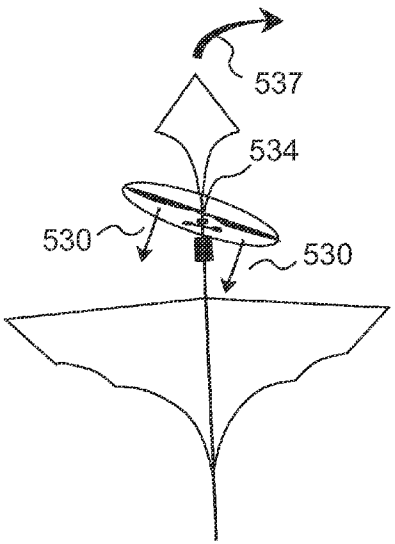
FIG. 27 is a side view illustration of a fourth contemplated mode of operation of the thrust control apparatus shown in FIGS. 22 and 23.
Figure 26:
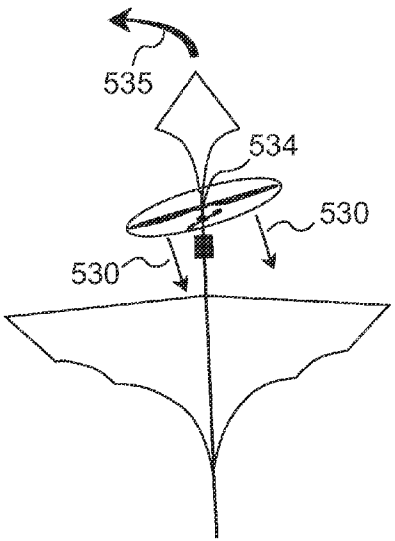
FIG. 26 is a side view illustration of a third contemplated mode of operation of the thrust control apparatus shown in FIGS. 22 and 23.

FIG. 24, FIG. 25, FIG. 26 and FIG. 27 are illustrations that depict the basic control of a kite-like object using a teetering top rotor hub 534. Arrows 530 show the direction of thrust generated and arrows 531, 533, 535, 537 show the corresponding direction of flight of a kite-like object. In FIG. 24 the teetering hub 534 is tilting downward which in turn delivers upward thrust 530 and pushes the kite-like object down 531. In FIG. 25 the teetering hub 534 is tilting upward which, in turn, delivers downward thrust 530 and pushes the kite-like object upward 533. In FIG. 26, the teetering hub 534 is tilting toward the left which in turn delivers rightward thrust 530 and pushes the kite-like object to the left 535. In FIG. 27, the teetering hub 534 is tilting toward the right which in turn delivers leftward thrust 530 and pushes the kite-like object to the right 537.

In the present embodiment, vector thrust control apparatus 502 utilizes two propeller blades 509. While this is the suggested number of propeller blades, it should be noted that two propeller blades are preferred to practice the present invention. On the other hand, any number greater than one is believed to be sufficient to produce controlled thrust with vector thrust control apparatus 502 that utilizes a teetering hub. Of course, as would be appreciated by those skilled in the art, three, four, five, six or a multiple of separate propeller blades may be employed without departing from the intended scope of the present invention.

Although a teetering hub uses a swash plate similar to the cyclic pitch modulation apparatus, the teetering top rotor hub apparatus differs from cyclic pitch modulation in that the entire rotational plane of the propeller changes angles. The teetering hub design works closer to the principle of the gimbal vector thrust control apparatus, however, the main difference is that the motor and drive axle stay stationary while the propeller blades change rotational plane angles through the use of a swash plate. A stationary motor and drive axle in conjunction with a movable swash plate is also a notable feature of the cyclic pitch modulation thrust apparatus.

The construction of vector thrust apparatus using swash plates to control and propel kite-like objects offers other advantages that are not present in prior art. In particular, it is known to the inventors that keeping the drive motor and main axle stationary in a vector thrust apparatus may have advantages in applications that would prohibit or be difficult in terms of installing certain size or certain type motors in a gyratory gimbal system. Also, it is known to the inventors that miniature swash plates, linkage rods, ball joints and other parts used in common toy helicopter design may be utilized to aid production and quality of mass produced vector thrust apparatus for kite-like objects.

FIG. 1A, FIG. 2A, FIG. 2C, FIG. 2D, FIG. 2E, FIG. 3, FIG. 5, FIG. 6, FIG. 7, FIG. 8, FIG. 12A, FIG. 12B, FIG. 15, FIG. 18, FIG. 19, FIG. 20, FIG. 21, FIG. 24, FIG. 25, FIG. 26 and FIG. 27, among others, illustrate vector thrust control apparatuses in which the propeller is in the front of the vector thrust control apparatus. In the vernacular of aircraft construction, this front propeller arrangement would be termed a "tractor" style of aircraft power. FIG. 2B, FIG. 2F, and FIG. 16 illustrates a kite-like object in which the propeller is behind the vector thrust control apparatus. In the vernacular of aircraft construction, this front propeller arrangement would be termed a "pusher" style of aircraft power. In another words the vector thrust control apparatus is located in the front of the kite-like object and is pushing the kite-like object as opposed to pulling it. Regardless of whether the vector thrust control units as taught in the present invention are used as a pusher style or tractor style of kite-like propulsion, both methods have been contemplated and remain in the scope of the present invention.

It is also know to the inventors that a combination of cyclic pitch modulation, collective pitch modulation, teetering hub modulation and gimbal thrust modulation may all be used together, in selected groups or individually on one vector thrust control apparatus to use vector thrust to control and propel a kite-like object. For example, it has been contemplated that teetering hub modulation and cyclic pitch modulation could be integrated and used together on a single vector thrust control apparatus for more effective control of a kite-like object. In another example, it has been contemplated that cyclic pitch modulation and collective pitch modulation could be integrated and used together on a single vector thrust control apparatus for more effective control of a kite-like object. In other words, the present invention, as defined by the claims appended hereto, is intended to encompass all of the aspects taught in the present invention whether used as separate elements or a combination of elements.

While various aspects of the present invention have been described in connection with specific, contemplated embodiments, the features are not intended to be limited to any particular embodiment. In other words, features and aspects of one embodiment may be employed and/or combined with features of another embodiment without departing from the scope of the present invention.

While there has been described in connection with the preferred embodiments of the disclosure, various changes and modifications may be aimed, therefore, to cover in the appended claims all such changes and modifications as fall within the true spirit of the disclosure.

What is claimed is:

1. A motorized kite-like object, comprising:

a frame;

a flexible material disposed on at least a portion of the frame;

a propulsion motor;

an inner gimbal bracket supporting the motor;

an outer gimbal bracket supporting the inner gimbal bracket, wherein the inner gimbal bracket is mounted pivotally within the outer gimbal bracket and the outer gimbal bracket is mounted pivotally to the frame, thereby allowing the propulsion motor to pivot up and down and from side to side;

inner and outer servo motors connected to said inner and outer gimbal brackets to move said inner and outer gimbal brackets and, thereby to move said motor up and down and from side to side;

inner and outer linkage rods connected between each of said inner and outer servo motors and said inner and outer gimbal brackets; and an electronic receiver connected to said inner and outer servo motors to receive commands and to move said inner and outer gimbal brackets and also connected to said motor to receive commands and to control a speed of said motor.

2. The motorized kite-like object of claim 1, wherein the inner and outer linkage rods are connected to the inner and outer gimbal brackets at orthogonal positions with respect to one another.

3. The motorized kite-like object of claim 1, wherein the frame comprises at least one framing rod having a cross sectional shape selected from a group comprising circular, triangular, square, rectangular, polygonal, elliptical, and ovoid.

4. The motorized kite-like object of claim 1, wherein the propulsion motor is selected from a group comprising a brushless electric motor and an electric motor with brushes.

5. The motorized kite-like object of claim 1, further comprising:

at least one lifting wing surface.

6. The motorized kite-like object of claim 1, wherein the inner gimbal bracket is mounted to the outer gimbal bracket along a first axis, the outer gimbal bracket is mounted to the frame along a second axis, and the first and second axes are orthogonal to one another.

7. The motorized kite-like object of claim 1, wherein:

the frame further comprises a connector fitting made from a material selected from a group comprising a flexible elastomer, rubber, silicon, metal, plastic;

the connector fitting comprises an open channel component, a receiver module, and a constrictor collar;

the open channel component has a cross-section selected from a group comprising round, square, triangular, rectangular, polygonal, elliptical and ovoid;

the open channel component has at least one end to fit the frame;

the open channel component comprises at least one protrusion and a connecting point allowing the open channel component to be connected to a receiver module and be adjusted rotationally along an axis in relation to the frame;

the receiver module comprises at least one aperture for receiving at least one frame element, at least one protrusion and a connecting point allowing the receiver module to be connected to the channel component and be adjusted rotationally along an axis in relation to the frame, a first inclined plane receives the constrictor collar and grips the frame when the constrictor collar is applied, the constrictor collar comprising at least one aperture for receiving the receiver module, and a second inclined plane receives the receiver module and grips the frame when the constrictor collar is applied.

8. The motorized kite-like object of claim 1, further comprising:

at least one connector element to connect at least the propulsion motor to the frame, wherein the connector element has a cross sectional shape selected from a group comprising cylindrical, triangular, square, rectangular, polygonal, elliptical, and ovoid, wherein the connector element is made from material selected from a group comprising metal, steel, aluminum, fiberglass composite, carbon graphite composite, plastic, molded plastic and reinforced plastic, wherein the connector element includes at least one release fitting to lock and unlock the propulsion motor to the frame, wherein the release fitting has a cross sectional shape selected from a group comprising cylindrical, triangular, square, rectangular, polygonal, elliptical, and ovoid, and wherein the release fitting is made from a material selected from a group comprising metal, steel, aluminum, fiberglass composite, carbon graphite composite, plastic, molded plastic and reinforced plastic.

9. The motorized kite-like object of claim 1, wherein the frame comprises:

a hook and loop fastener for attaching a battery to the frame, thereby permitting a change in the center of gravity of the motorized kite-like object.

10. A motorized kite-like object of claim 1, wherein:

at least the propulsion motor is secured on the frame by a gravitationally oriented hub made from a material selected from a group comprising metal, steel, aluminum, fiberglass composite, carbon graphite composite, plastic, molded plastic and reinforced plastic, wherein the gravitationally oriented hub has at least one spindle rotatable about a spindle axis, wherein the spindle supports and connects to at least one elongated protrusion, wherein the elongated protrusion includes a receiving portion for a battery to power the vector thrust control apparatus, wherein the spindle is rotatable around a kite frame rod, and wherein the elongated protrusion is oriented perpendicular to a direction of gravity as the frame rod turns.

11. The motorized kite-like object of claim 1, further comprising:

at least one lifting wing surface; and at least one control surface on the at least one lifting wing surface, wherein the at least one control surface is controlled by at least one of the servo motors.

12. The motorized kite-like object of claim 1, further comprising:

at least one lifting wing surface; and at least one control surface on the at least one lifting wing surface, wherein the at least one control surface is controlled by a servo motor dedicated to the control surface.

13. The motorized kite-like object of claim 1, further comprising:

a wireless control mechanism to send the commands to the electronic receiver.

14. The motorized kite-like object of claim 1, wherein the flexible material is selected from a group comprising aluminum, metal, nylon fabric, polyester fabric, woven synthetic fabric, plastic, foam material, foamed plastics, expanded polystyrene, extruded polystyrene foam, plastic film, polyester film, low density polyethylene, and high density polyethylene.

15. The motorized kite-like object of claim 14, wherein the frame comprises a material selected from a group comprising aluminum, metal, carbon graphite, fiberglass, plastic, wood, foam material, foamed plastics, expanded polystyrene, and extruded polystyrene foam.

16. The motorized kite-like object of claim 15, wherein the frame and the flexible material comprise a homogenous material selected from a group comprising aluminum, metal, plastic, wood, foam material, foamed plastics, expanded polystyrene, and extruded polystyrene foam.

* * * * *